US007218305B2

(12) United States Patent
Nose

(10) Patent No.: US 7,218,305 B2
(45) Date of Patent: May 15, 2007

(54) LIQUID CRYSTAL DISPLAY AND COMPUTER

(75) Inventor: Takashi Nose, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/974,881

(22) Filed: Oct. 12, 2001

(65) Prior Publication Data

US 2003/0001983 A1 Jan. 2, 2003

(30) Foreign Application Priority Data

Oct. 13, 2000 (JP) ..... 2000-314274

(51) Int. Cl.
*G09G 3/36* (2006.01)

(52) U.S. Cl. ..... 345/102; 345/89; 345/100

(58) Field of Classification Search ..... 345/87, 345/102, 92, 100, 89
See application file for complete search history.

(56) References Cited

U.S. PATENT DOCUMENTS

| | | | | |
|---|---|---|---|---|
| 4,958,915 A | | 9/1990 | Okada et al. | |
| 5,184,117 A | | 2/1993 | Gautheir | |
| 5,337,068 A | * | 8/1994 | Stewart et al. | 345/88 |
| 5,406,305 A | | 4/1995 | Shimomura et al. | |
| 5,786,801 A | | 7/1998 | Ichise | |
| 5,818,409 A | * | 10/1998 | Furuhashi et al. | 345/94 |
| 5,844,540 A | * | 12/1998 | Terasaki | 345/102 |
| 5,894,304 A | * | 4/1999 | Hirano | 345/179 |
| 5,949,391 A | | 9/1999 | Saishu et al. | |
| 6,057,847 A | * | 5/2000 | Jenkins | 345/422 |
| 6,069,600 A | | 5/2000 | Saishu et al. | |
| 6,380,932 B1 | * | 4/2002 | Kawasaki et al. | 345/213 |
| 6,452,582 B1 | * | 9/2002 | Rolston | 345/102 |
| 6,597,339 B1 | * | 7/2003 | Ogawa | 345/102 |
| 6,937,224 B1 | * | 8/2005 | Miyachi | 345/102 |

FOREIGN PATENT DOCUMENTS

| | | |
|---|---|---|
| EP | 1 061 499 A2 | 12/2000 |
| EP | 1 120 679 A1 | 8/2001 |
| JP | H6-47989 | 6/1994 |
| JP | 09-127917 | 5/1997 |
| JP | 10-62811 | 3/1998 |
| JP | H10-207425 | 8/1998 |
| JP | 11-30789 | 2/1999 |
| JP | 2000-105575 | 4/2000 |

* cited by examiner

*Primary Examiner*—Richard Hjerpe
*Assistant Examiner*—Kimnhung Nguyen
(74) *Attorney, Agent, or Firm*—Sughrue Mion, PLLC

(57) ABSTRACT

A backlight control circuit that variably controls the display luminance of a liquid crystal display panel by controlling the luminance of a backlight based upon whether an image displayed on the liquid crystal display panel is a dynamic image or a static image, and an LCD controller that controls so that a part or the whole of a dynamic image is displayed by using a single color for a predetermined time in case an image displayed on the liquid crystal display panel is a dynamic image are provided.

25 Claims, 14 Drawing Sheets

LIQUID CRYSTAL DISPLAY AND COMPUTER

BACKGROUND OF THE INVENTION

1. Field of the Invention

The present invention generally relates to a liquid crystal display and a computer, particularly but not limited to, an active matrix liquid crystal display suitable for the display of a dynamic image and a computer suitably used with the liquid crystal display. The present application is based on Japanese Patent Application No. 314274/2000, which is incorporated herein by reference.

2. Description of the Related Art

Recently, the display screen of a liquid crystal display (LCD) has been enlarged and the definition has been enhanced. A displayed image ranges from a static image as in a liquid crystal display used for a personal computer, a word processor and the like, to a dynamic image as in a liquid crystal display used for TV and the like. Since the compression technology for dynamic images has progressed and a dynamic image can now be also easily handled in a computer, a frequency at which a dynamic image is displayed also increases in a liquid crystal display used for a personal computer and the like. It is conceivable that as LCD is thin, compared with TV provided with a cathode ray tube (CRT), and can be installed without occupying a large place, the ratio of popularization of LCD TVs in the general home will increase in the future.

FIG. 1 is a block diagram showing the schematic structure of a liquid crystal display as a related art. In FIG. 1, a case that a computer 100 such as a personal computer and a liquid crystal display 110 are separately provided is shown as an example. As shown in FIG. 1, gradation data D100 and synchronism data D101 are output from the computer 100 to the liquid crystal display 110. For example, gradation data D100 means an RGB signal and synchronism data D101 is data including a vertical synchronizing signal, a horizontal synchronizing signal, a data enable signal (DE) and a clock.

The liquid crystal display 110 includes an LCD controller 112, a liquid crystal display panel 114, a signal line driving circuit 116, a scanning line driving circuit 118, a reference gradation voltage generator 120, a backlight 122 and an inverter for the backlight 124. The LCD controller 112 generates gradation data D110 and a signal side control signal D111 respectively output to the signal line driving circuit 116 based upon gradation data D100 and synchronism data D101 respectively output from the computer 100. The LCD controller 112 also generates a scanning side control signal D112 output to the scanning line driving circuit 118 and controls the displayed contents of an image displayed on the liquid crystal display panel 114.

Referring to FIG. 2, the structure of the liquid crystal display panel 114 will be described below. FIG. 2 shows an example of the structure of an active matrix LCD as a related art. Though the first and second glass substrates are not shown in FIG. 2, LCD is provided with the first and second glass substrates. On the first glass substrate, n scanning lines 131 (n: natural number) and m signal lines 132 (m: natural number) are arranged in a grid and a thin film transistor (TFT) 133 which is a nonlinear device (a switching device) is provided in the vicinity of each cross-point of the scanning line 131 and the signal line 132.

The gate electrode of TFT 133 is connected to the scanning line 131, the source electrode is connected to the signal line 132 and the drain electrode is connected to a pixel electrode 134. The second glass substrate is arranged in a position opposite to the first glass substrate and a common electrode 135 is formed on one surface of the glass substrate by a transparent electrode such as an indium-thin-oxide (ITO) film. Each common electrode 135 is connected to a common electrode driving circuit 136 and the electric potential is set by the common electrode driving circuit 136. Liquid crystal is filled between the common electrode 135 and the pixel electrode 134 formed on the first glass substrate.

The scanning line 131 and the signal line 132 are respectively connected to the scanning line driving circuit 118 and the signal line driving circuit 116. The scanning line driving circuit 118 executes scanning by sequentially applying high potential to n scanning lines 131 and turns on the TFT 133 connected to each scanning line 131. Gradation voltage is written to the pixel electrode 134 via turned-on TFT 133 when the signal line driving circuit 116 outputs gradation voltage. The signal line driving circuit 116 outputs gradation voltage according to image data to one of the m signal lines 132 while the scanning line driving circuit 118 turns on the scanning line 131. The amount of transmitted light is controlled based upon potential difference between the common electrode 135 set to a fixed potential and the gradation voltage written to the pixel electrode 134.

As shown in FIG. 1, the liquid crystal display 110 is provided with the backlight 122 and the inverter for the backlight 124 for supplying power to the backlight 122. As the backlight 122 emits light at fixed luminance in a state in which the liquid crystal display 110 is operated, the amount of transmitted light emitted from the backlight 122 is controlled and display is made according to the above-mentioned operational principle. The reference gradation voltage generator 120 shown in FIG. 1 supplies reference gradation voltage to the signal line driving circuit 116.

FIG. 3 shows the waveforms of signals output from the scanning line driving circuit 118 and the signal line driving circuit 116, which are respectively provided to the scanning line 131 and the signal line 132 in the conventional type liquid crystal display. In FIG. 3, an x-axis shows time and VG1 to VGn respectively show the waveform of a scanning signal applied to each scanning line 131. As shown in FIG. 3, high potential is applied to only one scanning line 131 at a time and the scanning signals VG1 to VGn are signals sequentially output to n scanning lines 131. VD shows the waveform of a signal output to one signal line 132 and Vcom shows the waveform of a signal applied to the common electrode 135. In an example shown in FIG. 3, the signal strength of the signal VD varies according to each image data, and the signal Vcom has a fixed value and is a signal which does not vary with time.

The liquid crystal display of the related art and its driving method are described above. However, in the liquid crystal display of the related art, voltage applied to each pixel electrode 134 is held until the scanning line is selected next, thereby fixing transmitted light for one frame period. In the meantime, CRT sequentially scans using an electronic beam. In case a dynamic image is displayed on this LCD, a problem occurs in that the image quality deteriorates due to causes such as a residual image phenomenon. The cause of this deterioration is thought to be because the speed of a response of liquid crystal material is slow. As a result, when gradation varies, the variation of gradation cannot be completed in one field period and an accumulative response is performed in a few field periods. One approach to preventing this deterioration has involved the research of various liquid crystal materials that enable a high speed response.

However, it has been reported that the above-mentioned problems such as the residual image phenomenon are not caused by only the speed of the response of liquid crystal, but are also caused by the methods used to change the image displayed on LCD. Such reports have been made by NHK Broadcast Technical Research Institute and others (for example, refer to pp. 207 and 208 of SC-8-1 at 99' General Meeting of The Institute of Electronics, Information and Communication Engineers). To address the problems caused by the conventional methods used to change the image displayed on LCD, a method of driving CRT and a method of driving LCD will be described and compared below.

FIGS. 4A and 4B show the result of comparison between CRT and LCD in the time response of display light at a certain pixel. FIG. 4A shows the time response of CRT and FIG. 4B shows the time response of LCD. As shown in FIG. 4A, CRT is a so-called "impulse display" that emits light only for a few milliseconds since an electronic beam reaches a fluophor on the surface of the tube, while LCD shown in FIG. 4B is a so-called "hold-type display" that holds display light for one field period since the writing of data to a pixel is finished until the next writing is started.

When a dynamic image is displayed on CRT and LCD respectively having such characteristics, display as shown in FIGS. 5A and 5B are made. FIGS. 5A and 5B show examples of when a dynamic image is respectively displayed on CRT and LCD, FIG. 5A showing the example of CRT, and FIG. 5B showing the example of LCD. In FIGS. 5A and 5B, a circular display object moves in a direction shown by x. As shown in FIG. 5A, a display object is instantaneously displayed in a position corresponding to time on CRT, while an image before one field remains until immediately before new writing on LCD.

In case a person looks at a dynamic image displayed as shown in FIGS. 5A and 5B, the dynamic image is viewed as shown in FIGS. 6A and 6B. FIGS. 6A and 6B are explanatory drawings for explaining an image viewed by a person when a dynamic image is displayed on CRT and LCD, FIG. 6A showing a case of CRT and FIG. 6B showing a case of LCD. As shown in FIG. 6A, when a dynamic image is displayed on CRT, it is never viewed that an image displayed at a certain time is overlapped with an image from before that time. However, when a dynamic image is displayed on LCD, an image currently displayed is viewed in a state in which it, and an image displayed immediately before it, are overlapped due to the visual time integral effect and other effects, causing movement to become dim.

Some methods have been proposed for reducing the hold time of the displayed image by inputting voltage corresponding to a black image, prior to inputting voltage according to image data into each pixel electrode 134 of the liquid crystal display panel 114. Such proposed methods prevent movement from being dim, thereby solving the above-mentioned problems caused when a dynamic image is displayed on LCD. FIGS. 7A to 7D are explanatory drawings for explaining a method of preventing movement from being dim by inserting a black image between each image data. This method basically prevents movement from being dim by applying predetermined voltage for black display to liquid crystal for a horizontal blanking period as shown in FIG. 7A. That is, after an image in one field is displayed, black is displayed on the whole screen and an image in the next field is displayed. However, according to this method, as display time is different for each respective scanning line of the liquid crystal display panel 114. This difference in display time causes a problem in that luminance difference depends upon the location on the liquid crystal display panel 114 as shown in an example in FIG. 7C.

A method of preventing luminance difference from being caused is proposed in Japanese published unexamined patent applications No. Hei. 9-127917, No. Hei. 10-62811 and Japanese published unexamined patent applications No. Hei. 11-30789. FIG. 8 shows the structure of a liquid crystal display to solve the problem caused by the method shown in FIG. 7A. This structure is proposed in the above-mentioned patent application No. Hei. 9-127917. The same reference number is allocated to the same member as that in the liquid crystal display shown in FIG. 2.

In FIG. 8, in addition to the circuit structure shown in FIG. 2, a circuit for writing black is newly provided, including: a black signal feeder 140, a black signal supply line 141, a scanning line for supplying a black signal 142, TFT for supplying a black signal 143 and a scanning line driving circuit 144 for driving the scanning line 142 for supplying a black signal. The gate electrode of the TFT for supplying a black signal 143 is connected to the scanning line for supplying a black signal 142, the source electrode of the TFT for supplying a black signal 143 is connected to the black signal supply line 141 and the drain electrode is respectively connected to the drain electrode of TFT 133 and the pixel electrode 134.

In the liquid crystal display having the above-mentioned configuration, voltage corresponding to black is applied to the pixel electrode 134 in one field, and afterward, voltage according to image data is applied to the pixel electrode 134. Image data is reset by independently driving each scanning line as described above, and illustrated in the example shown in FIG. 7B. That is, difference in luminance is prevented by resetting each scanning line independently, inserting black after each image is displayed, instead of resetting all of the scanning lines simultaneously as shown in FIG. 7A. By resetting the scanning lines as shown in FIG. 7B, the screen luminance differences can be prevented, as shown by the panel display in FIG. 7D.

However, the deterioration of image quality such as a flicker occurs due to a black screen inserted also in the display of a static image, both in the method shown in FIGS. 7A and 7C and in the device shown in FIG. 8, even though a hold-type display is suited for the display of the static image. Also, because the brightness of a display screen is reduced when a black screen is inserted, the luminance of the backlight is required to be set to a high value so as to acquire the brightness of the same extent as the brightness acquired in case no black screen is inserted. This increase in the luminescence of the back light increases power consumption, which is also a problem.

A liquid crystal display in the present invention may display a dynamic image without dim movement or without the deterioration of luminance. A liquid crystal display in the present invention also may display a static image without needless power consumption or without the deterioration of image quality such as a flicker. Further, a computer suitably used with the liquid crystal display is provided by the illustrative embodiment of the present invention.

SUMMARY OF THE INVENTION

A first aspect of an illustrative embodiment provides a liquid crystal display comprises a display panel, a back light irradiating said display panel; and a back light control circuit making a brightness of said back light brighter at a first period than at a second period, wherein said display panel displays a dynamic image at said first period, and wherein said display panel displays a static image at said second period.

A second aspect of the embodiment provides the liquid crystal display, wherein said back light control circuit controls said back light based on an image discriminating signal indicating an active state at said first period and an inactive state at said second period.

A third aspect of the embodiment provides the liquid crystal display comprising, a controller controlling said display panel in response to said image discriminating signal indicating said active state so that at least a part of said display panel displays a reset image.

A forth aspect of the embodiment provides the liquid crystal display, wherein said display panel comprises a plurality of cells, and wherein at least a part of said plurality of cells displays a single color as said reset image.

A fifth aspect of the embodiment provides the liquid crystal display, wherein said display panel comprises a scanning line, a signal line arranged substantially perpendicular to said scanning line, and a cell arranged at an intersection of said scanning line and said signal line, wherein at least a part of said cell displays a single color as said reset image.

A sixth aspect of the embodiment provides the liquid crystal display, wherein said controller activates a first scanning line at a first scanning period and provides an image data to a first signal line, and said controller activates a second scanning line at a second scanning period and provides a reset data to said first signal line, and wherein said first period and said second period are included in a basic period for scanning said scanning line.

A seventh aspect of the embodiment provides the liquid crystal display, further comprises at least one of a third scanning line arranged between said first scanning line and said second scanning line.

A eighth aspect of the embodiment provides the liquid crystal display, further comprising, an input terminal receiving said image discriminating signal and providing said image discriminating signal to said controller and said back light control circuit.

A ninth aspect of the embodiment provides the liquid crystal display, wherein said image discriminating signal indicates said active state when a ratio of an area of said display panel to an area of said dynamic image is larger than a threshold value.

A tenth aspect of the embodiment provides the liquid crystal display, wherein said controller receives a dynamic image data at said first period and a static image data at said second period, and wherein said controller controls said display panel to display a dynamic image corresponding to said dynamic image data at said first period and to display said static image corresponding to said static image data at said second period.

A eleventh aspect of the embodiment provides the liquid crystal display, further comprising: a computer comprising, a memory storing said threshold value; and a detector and comparator detecting said ratio of said area of said display panel and to said area of said dynamic image, comparing said ratio to said threshold value, and providing said image discriminating signal into said controller and said back light control circuit, wherein said image discriminating signal indicates said active state when said ratio is larger than said threshold value.

A twelfth aspect of the embodiment provides the liquid crystal display, wherein said image discriminating signal indicates said inactive state when said ratio is smaller than said threshold value.

A thirteenth aspect of the embodiment provides the liquid crystal display, further comprising, an image discriminating unit receiving an image data and providing said image discriminating data indicating said active state into said back light control circuit when said image data comprises a dynamic image data, wherein said dynamic image data corresponds to said dynamic image.

A fourteenth aspect of the embodiment provides the liquid crystal display, wherein said image discriminating unit provides said image discriminating data indicating said inactive state into back light control circuit when said image data comprises a static image data, and wherein said static image data corresponds to said static image.

A fifteenth aspect of the embodiment provides the liquid crystal display, wherein said image data comprises a first part of said image data corresponding to a first frame and a second part of said image data corresponding to a second frame, and wherein said image discriminating unit comprises a memory storing said first part of said image data at said first frame, and a comparator comparing said first part of said image data with said second part of said image data at said second frame, and detecting that said image data comprises said dynamic image data when said first part of said image data is different from said second part of said image data.

A sixteenth aspect of the embodiment provides the liquid crystal display, wherein said comparator detects that said image data comprises said static image data when said first part of said image data is the same as said second part of said image data.

A seventeenth aspect of the embodiment provides the liquid crystal display, wherein said image data comprises a first part of said image data corresponding to a first frame and a second part of said image data corresponding to a second frame, and wherein said image discriminating unit divides said first part of said image data into a first plurality of partial data corresponding to a plurality of detecting blocks of said display panel and said second part of said image data into a second plurality of partial data corresponding to a plurality of detecting blocks of said display panel.

A eighteenth aspect of the embodiment provides the liquid crystal display, wherein said image discriminating unit comprises a memory storing said first part of said image data at said first frame, and a comparator detecting said first plurality of partial data at said first frame which is different from said second plurality of said second data at said second frame, providing a number of detected said first plurality of partial data at said first frame, and providing said image discriminating signal indicating said active state when said number is larger than a predetermined value.

A nineteenth aspect of the embodiment provides the liquid crystal display, wherein said image data comprises a first part of said image data corresponding to a first frame and a second part of said image data corresponding to a second frame, and wherein said image discriminating unit define a first plurality of partial data corresponding to a plurality of detecting points of said display panel in said first part of said image data and a second plurality of partial data corresponding to a plurality of detecting points of said display panel in said second part of said image data.

A twentieth aspect of the embodiment provides the liquid crystal display, wherein said image discriminating unit comprises a memory storing said first part of said image data at said first frame, and a comparator detecting said first plurality of partial data at said first frame which is different from said second plurality of said second data at said second frame, providing a number of detected said first plurality of partial data at said first frame, and providing said image discriminating signal indicating said active state when said number is larger than a predetermined value.

BRIEF DESCRIPTION OF THE DRAWINGS

Features of the illustrative, non-limiting embodiments of the present invention will be more apparent from the following description taken in conjunction with the accompanying drawings, in which.

BRIEF DESCRIPTION OF THE EMBODIMENTS

The following description of the embodiments discloses specific configurations, features, and operations. However, the embodiments are merely examples of the present invention, and thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations, features, and operations of the present invention that would have been known to one skilled in the art are omitted for the sake of clarity and brevity.

Figure 9:
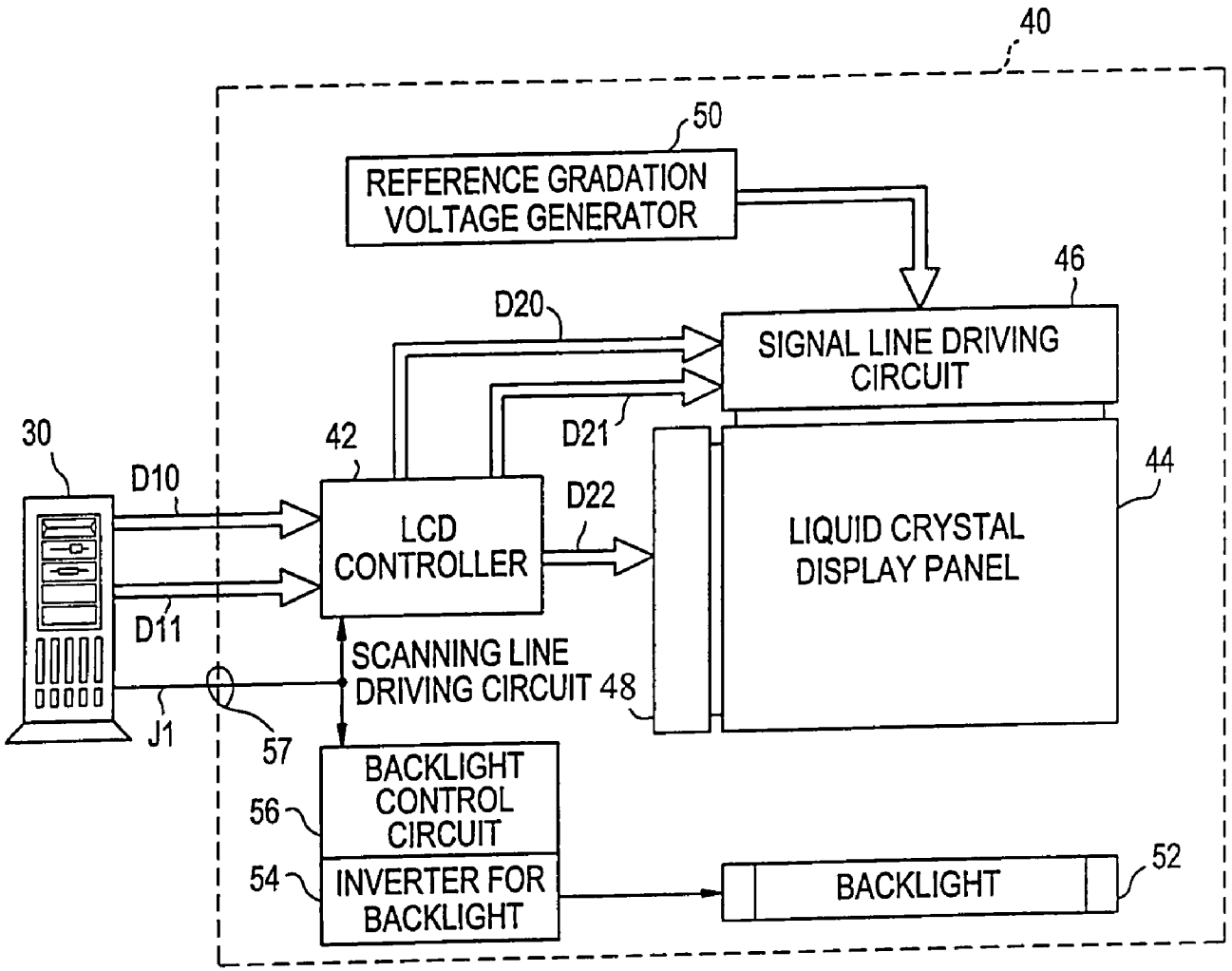
FIG. 9 is a functional block diagram showing the schematic structure of a liquid crystal display equivalent to a first embodiment of the invention.

FIG. 9 is a functional block diagram showing the schematic structure of a liquid crystal display according to a first illustrative, non-limiting embodiment of the present invention. In the first embodiment as shown in FIG. 9, a computer 30 such as a personal computer and the liquid crystal display 40 are separately provided. The computer 30 outputs gradation data D10, synchronism data D11 and an image discriminating signal J1 to the liquid crystal display 40.

Figure 1:
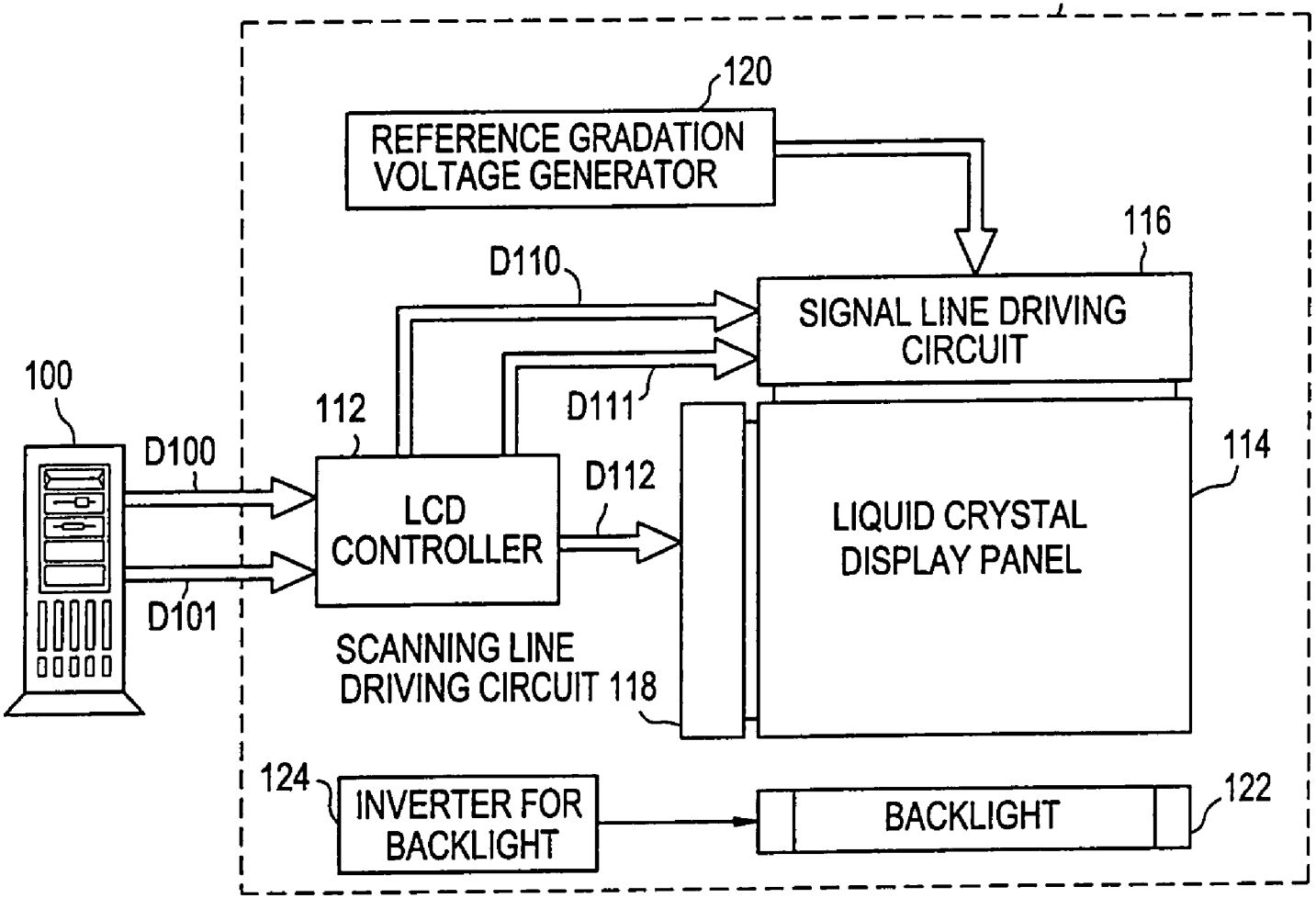
FIG. 1 PRIOR ART
FIG. 1 is a block diagram showing the schematic structure of a conventional type liquid crystal display.

The gradation data D10 and the synchronism data D11 are respectively similar signals to gradation data D100 and synchronism data D101 shown in FIG. 1. For example, the gradation data D10 is an RGB signal, and the synchronism data D11 is data including a vertical synchronizing signal, a horizontal synchronizing signal, a data enable signal (DE) and a clock. The image discriminating signal J1 is a signal of one bit showing whether image data (a signal composed of the gradation data D10 and the synchronism data D11) outputted from the computer 30 to the liquid crystal display 40 is a dynamic image or not.

The image discriminating signal J1 at a high level indicates that image data is a dynamic image and its at a low level indicates that image data is a static image. The image discriminating signal J1 may be set so that the value is at a high level, for example, when an application for handling a dynamic image is run in the computer 30. Also, in another example, the value may be set to a high level when the computer 30 comprises a TV tuner and the image data are based upon a signal output from the TV tuner. Further, in another example, the value may be also set manually by a user of the computer 30.

The liquid crystal display 40 includes an LCD controller 42, a liquid crystal display panel 44, a signal line driving circuit 46, a scanning line driving circuit 48, a reference gradation voltage generator 50, a backlight 52, an inverter for the backlight 54 and a backlight control circuit 56. The LCD controller 42 generates gradation data D20 and a signal side control signal D21 outputted to the signal line driving circuit 46, which are based respectively upon the gradation data D10 and the synchronism data D11 outputted from the computer 30. The LCD controller 42 also generates a scanning side control signal D22 outputted to the scanning line driving circuit 48 and controls image display contents on the liquid crystal display panel 44.

The liquid crystal display 40 comprises the discriminating signal input terminal 57 for outputting the image discriminating signal J1, outputted from the computer 30, to the LCD controller 42 and the backlight control circuit 56.

The LCD controller 42 controls the signal line driving circuit 46 and a scanning line driving circuit 48, to define whether a black display is performed or not based upon the image discriminating signal J1 when a dynamic image is displayed to prevent movement from being dim. The black display causes a deterioration of the luminance in the liquid crystal display panel 44, without regards to a dynamic image or a static image. The black display is required when the dynamic image is displayed in order to prevent movement from being dim. However, black display is not required when the static image is displayed because no movement is made in a static image. Then, the LCD controller 42 defines whether the gradation data D10 and the synchronism data D11 are for the dynamic image or for the static image based upon the image discriminating signal J1, and it controls the signal line driving circuit 46 and a scanning line driving circuit 48 so that the black display is not performed and an line-sequential driving is performed when a static image is displayed.

The backlight control circuit 56 outputs a control signal for controlling the luminance of light emitted from the backlight 52 for illuminating the rear surface of the liquid crystal display panel 44 to the inverter for the backlight 54 based upon the image discriminating signal J1 input via the discriminating signal input terminal. Concretely, in case the image discriminating signal J1 indicates a dynamic image, the luminance of light emitted from the backlight 52 is set to a high value to prevent the deterioration of display luminance caused due to black display for preventing movement from being dim. In the meantime, in case the image discriminating signal shows a static image, the luminance of light emitted from the backlight 52 is set to a low value from the viewpoint of the reduction of power consumption because the LCD controller 42 controls so that black display is not made. The reference gradation voltage generator 50 is similar to the reference gradation voltage generator 120 shown in FIG. 1.

Figure 3:
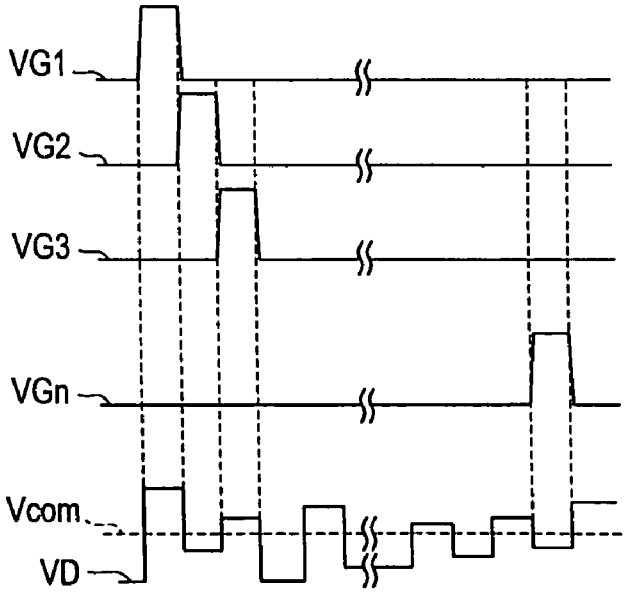
FIG. 3 PRIOR ART
FIG. 3 shows the waveforms of signals output from a scanning line driving circuit 118 and a signal line driving circuit 116 to a scanning line 131 and a signal line 132 in the conventional type liquid crystal display in FIG. 2.
Figure 4A:
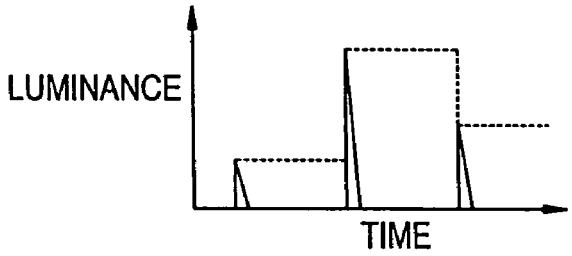
PRIOR ART FIG. 4A PRIOR ART
FIG. 4A shows the result of comparison in time response of display light in a pixel of a CRT.
Figure 4B:
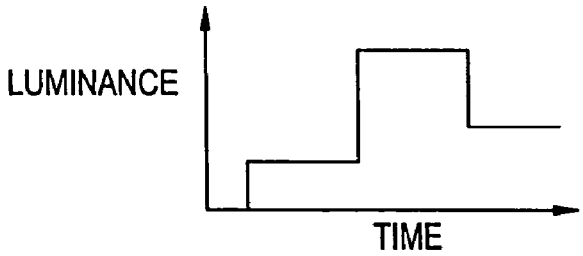
FIG. 4B shows the result of comparison in time response of display light in a pixel of a LCD.
Figure 5A:
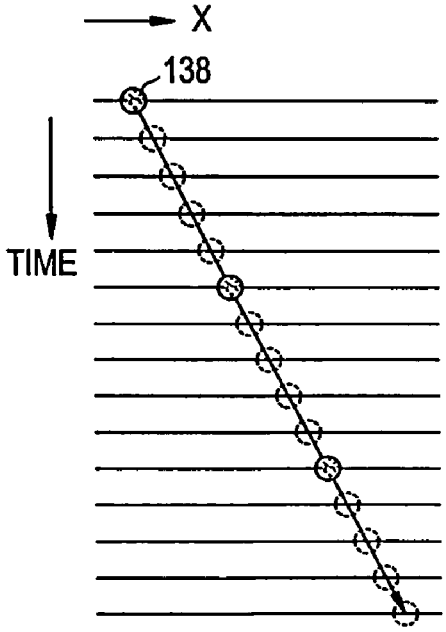
PRIOR ART FIG. 5A
FIG. 5A shows display examples of each image in case a dynamic image is displayed on a CRT.
Figure 5B:
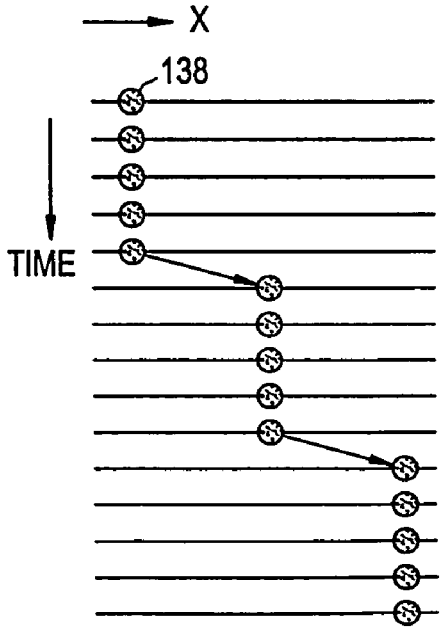
PRIOR ART FIG. 5B
FIG. 5B shows display examples of each image in case a dynamic image is displayed on a LCD.
Figure 6A:
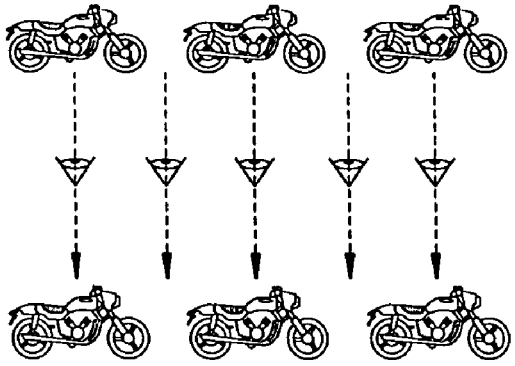
FIG. 6A PRIOR ART
FIG. 6A is an explanatory drawing for explaining an image viewed by a person when a dynamic image is displayed on a CRT.
Figure 6B:
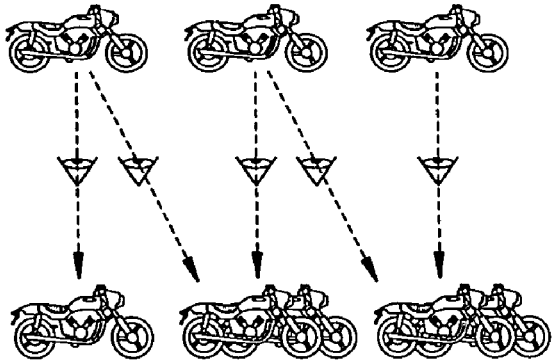
PRIOR ART FIG. 6B
FIG. 6B is an explanatory drawing for explaining an image viewed by a person when a dynamic image is displayed on a LCD.
Figure 7A:
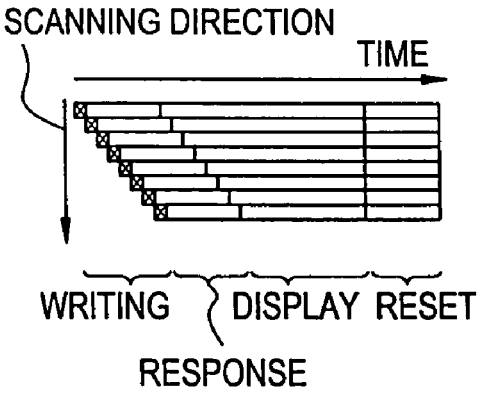
FIG. 7A PRIOR ART
FIG. 7A is an explanatory drawing for explaining a method of inserting a black image between each image data and preventing dim movement.
Figure 7B:
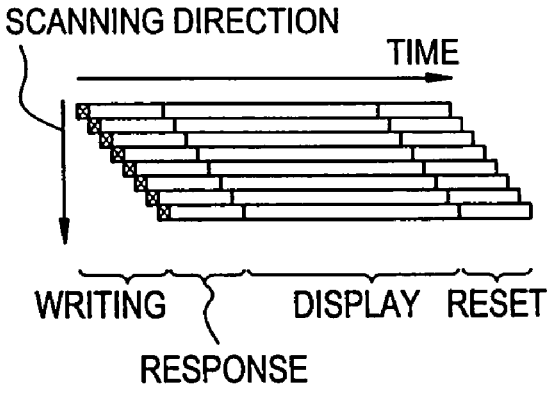
PRIOR ART FIG. 7B
FIG. 7B is an explanatory drawing for explaining a method of inserting a black image between each image data and preventing dim movement.
Figure 7C:
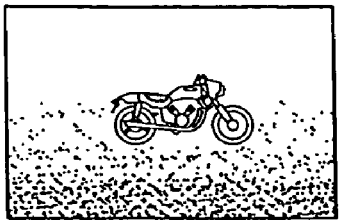
FIG. 7C PRIOR ART
FIG. 7C is an explanatory drawing for explaining a method of inserting a black image between each image data and preventing dim movement.
Figure 7D:
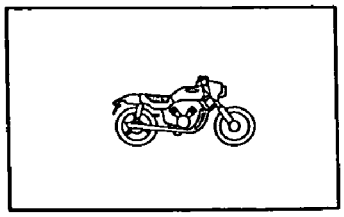
FIG. 7D PRIOR ART
FIG. 7D is an explanatory drawing for explaining a method of inserting a black image between each image data and preventing dim movement.
Figure 10:
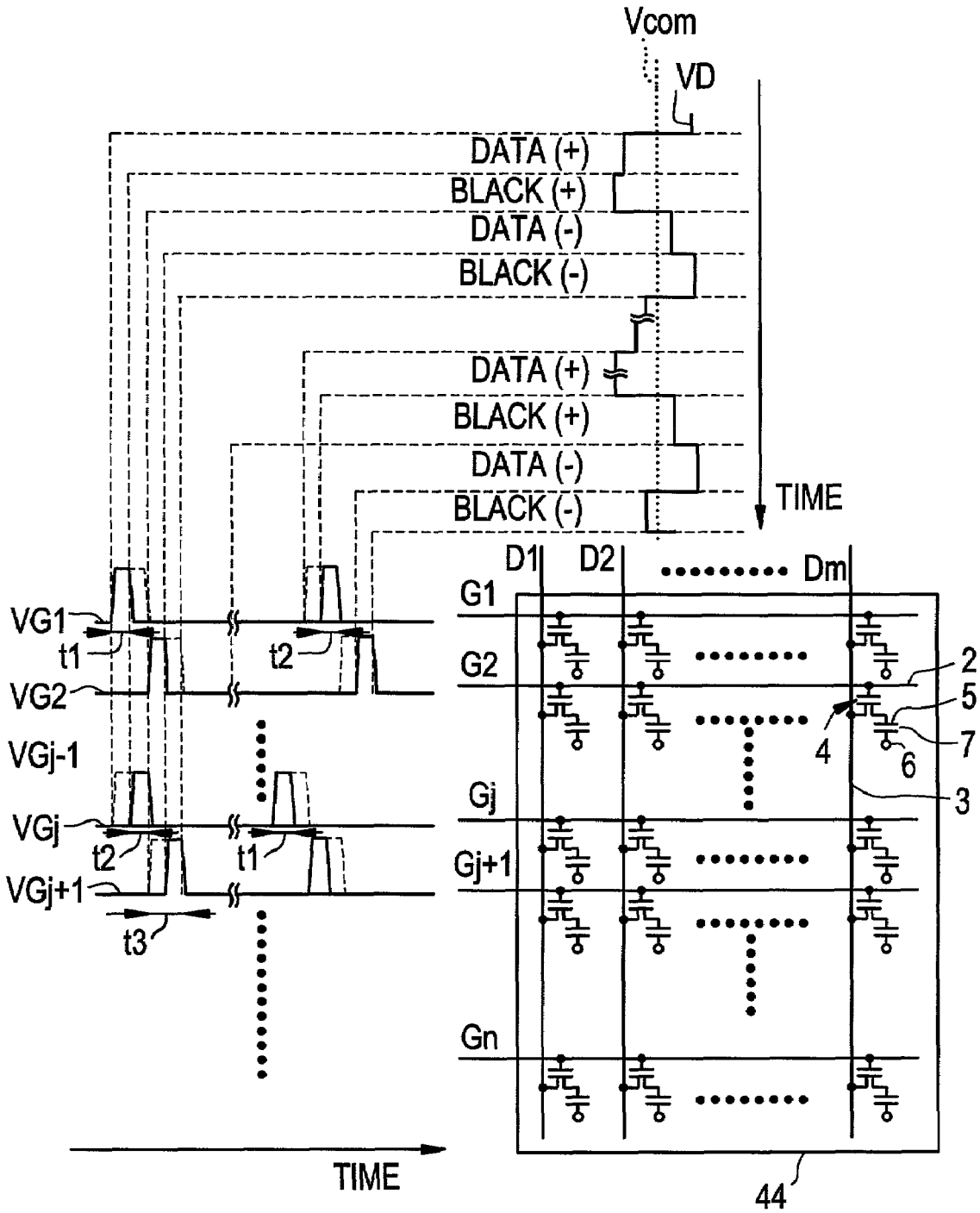
FIG. 10 shows the structure of a liquid crystal display panel 44 and the waveforms of a part of signals output from a signal line driving circuit 46 and a scanning line driving circuit 48 to the liquid crystal display panel 44.

Next, referring to FIG. 10, the structure of the liquid crystal display panel 44 will be described. FIG. 10 shows the structure of the liquid crystal display panel 44 and the waveforms of a part of signals output from the signal line driving circuit 46 and the scanning line driving circuit 48 to the liquid crystal display panel 44. The waveforms of the signals shown in FIG. 10 are those of signals respectively output from the signal line driving circuit 46 and the scanning line driving circuit 48 when a dynamic image is displayed and in the case of a static image, the waveforms of the similar signals to the waveforms shown in FIG. 3 are output and line-sequential driving is performed.

Figure 2:
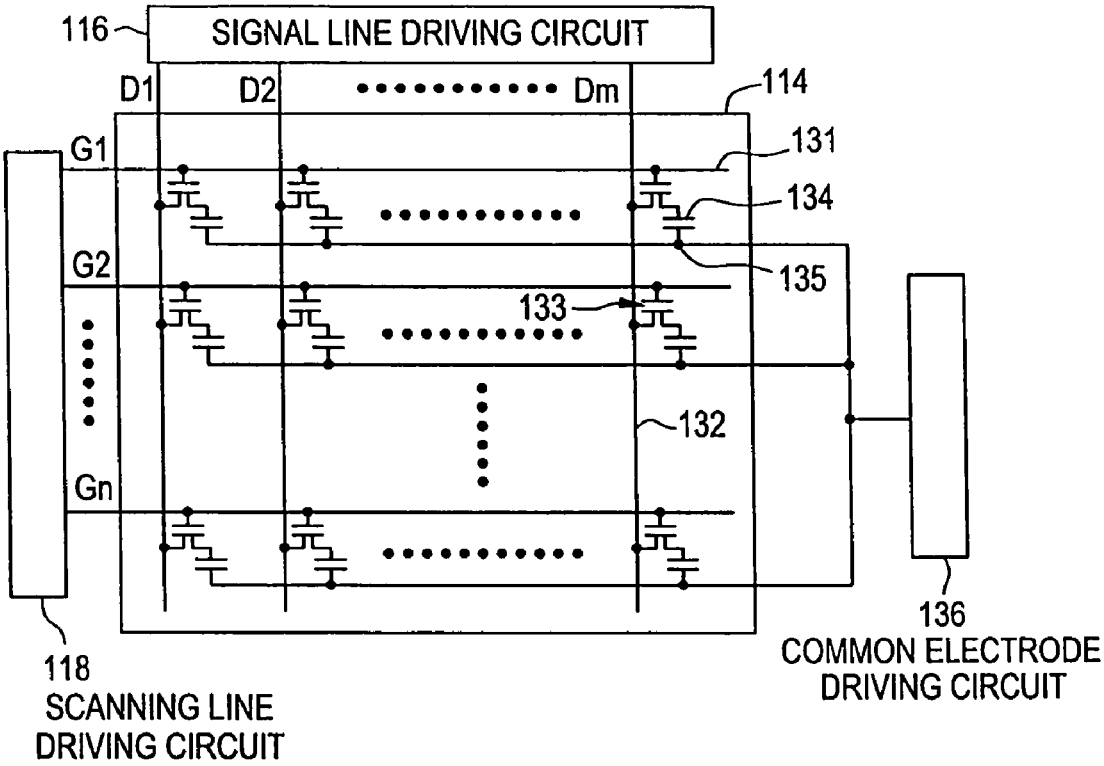
FIG. 2 PRIOR ART
FIG. 2 shows an example of the structure of conventional type active matrix LCD.

The liquid crystal display panel 44 shown in FIG. 10 is provided with first and second glass substrates as in the liquid crystal display 114 shown in FIG. 2. On the first glass substrate, n scanning lines 2 (n: natural number) and m signal lines 3 (m: natural number) are arranged in a grid, and TFT 4 which is a nonlinear device (a switching device) is provided in the vicinity of each cross-point of a scanning line 2 and a signal line 3.

The gate electrode of TFT 4 is connected to the scanning line 2, the source electrode is connected to the signal line 3 and the drain electrode is connected to a pixel electrode 5. The second glass substrate is arranged in a position opposite to the first glass substrate and a common electrode 6 is formed on one surface of the glass substrate by a transparent electrode such as ITO. Liquid crystal is filled between the common electrode 6 and the pixel electrode 5 formed on the first glass substrate.

Scanning signals VG1 to VGn in FIG. 10 are applied to each of the scanning lines 2, respectively. A signal VD in FIG. 10 corresponding to image data is applied to the signal line 3. As shown in FIG. 10, each of the scanning signals VG1 to VGn includes two scanning line selection periods which are a selection period for image data t1 and a selection period for black display t2 in one field. For a selection period for image data t1, writing gradation voltage according to image data is loaded to the pixel electrode 5. For a selection period for black display t2, writing voltage according to black display is loaded to the pixel electrode 5. Gradation voltage according to image data and voltage according to black display are alternately outputted to each signal line 3.

The selection period for black display t2 which is one characteristic of the first embodiment is corresponding to approximately a half of a conventional scanning line selection period t3 as shown in FIG. 10. For example, scanning line G1 is selected at the selection period for image data t1, and then the scanning line Gj, which is separated from the scanning line G1 by at least one other scanning line G2, is selected for black display at the selection period for black display t2. Voltage according to black display is applied to the signal line 3 in the selection period for black display t2, a black screen which is called a "reset image" is displayed because liquid crystal capacitance 7 shields light from the backlight 52. As describe above, scanning line 2 is selected individually for black display, which is so-called "reset driving", instead of selecting all scanning line for black display at the same time.

Next, the operation of the liquid crystal display in the first illustrative embodiment will be described in detail. In the following description, each of plural scanning lines 2 is discriminated using G1 to Gn and each of signals 3 is discriminated using D1 to Dm. Suppose that the display of image data is made in the order of the scanning line G1, G2, - - - and black display is made from the 'j'th (j: natural number: $1<j\leqq n$) scanning line Gj.

First, the scanning line G1 is selected for the selection period for image data t1 and in this state, gradation voltage according to image data is applied to the signal line D1. TFT 4 connected to the scanning line G1 is turned on and the display of the liquid crystal capacitance 7 begins to display according to image data. Next, the scanning line Gj is selected for the selection period for black display t2 and in this state, voltage according to black display is applied to the signal line 3. When this voltage is applied, TFT 4 connected to the scanning line Gj is turned on and the liquid crystal capacity 7 becomes black.

The selection period for black display t2 of the scanning line Gj elapses, and then the scanning line G2 is scanned and the similar operation to a case in which the scanning line G1 is scanned is executed. The scanning line Gj+1 is scanned next to the scanning line G2 and the similar operation to a case in which the scanning line Gj is scanned is executed. Afterward, similarly, the scanning line 2 is selected in the order of the scanning line G3, Gj+2, - - - . A band black screen display area shown in FIG. 11 is displayed on the liquid crystal display panel 44 by such a driving method.

Figure 11:
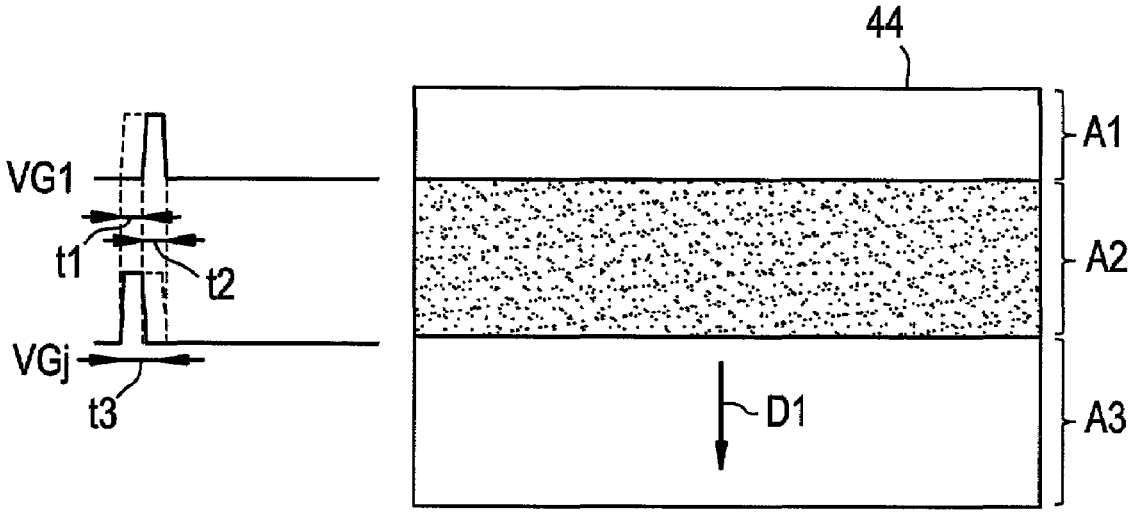
FIG. 11 shows the contents instantaneously displayed on the liquid crystal display panel 44 when a dynamic image is displayed.

FIG. 11 shows the contents displayed instantaneously on the liquid crystal display panel 44 when a dynamic image is displayed. As shown in FIG. 11, in case the selection period for black display t2 is set to substantially the center of the liquid crystal display panel 44, one screen is composed of three display areas of a normal image display area A1, a black screen display area A2 and a normal image display area A3. As time elapses, the black screen display area A2 is moved in a direction shown by an arrow D1 in FIG. 11. When the black screen display area A2 reaches the lower end of the liquid crystal display panel 44, a part of the black screen display area A2 is moved to the upper end of the liquid crystal display panel 44, the area occupied by the black screen display area A2 at the lower end decreases and the black screen display area A2 is moved in the direction shown by the arrow D1, increasing area occupied by the black screen display area A2 at the upper end.

As described above, in the first illustrative embodiment, black display prevents movement from being dim when a dynamic image is displayed. An interval between the scanning line selected in the selection period for black display t2 and the scanning line selected in the selection period for image data is equivalent to the black screen display area A2. A rate occupied by the black screen display area A2 on one screen is set to a degree at which dim movement is not identified when a dynamic image is displayed. The black screen display area A2 is scrolled by one scanning line 2 by making the above-mentioned black display as the normal image display areas A1 and A3. Therefore, luminance is almost similar at any location on the display screen.

It is described that the selection period for black display t2 is set after the selection period for image data t1. However, the selection period for image data t1 may be set after the selection period for black display t2.

Figure 12:
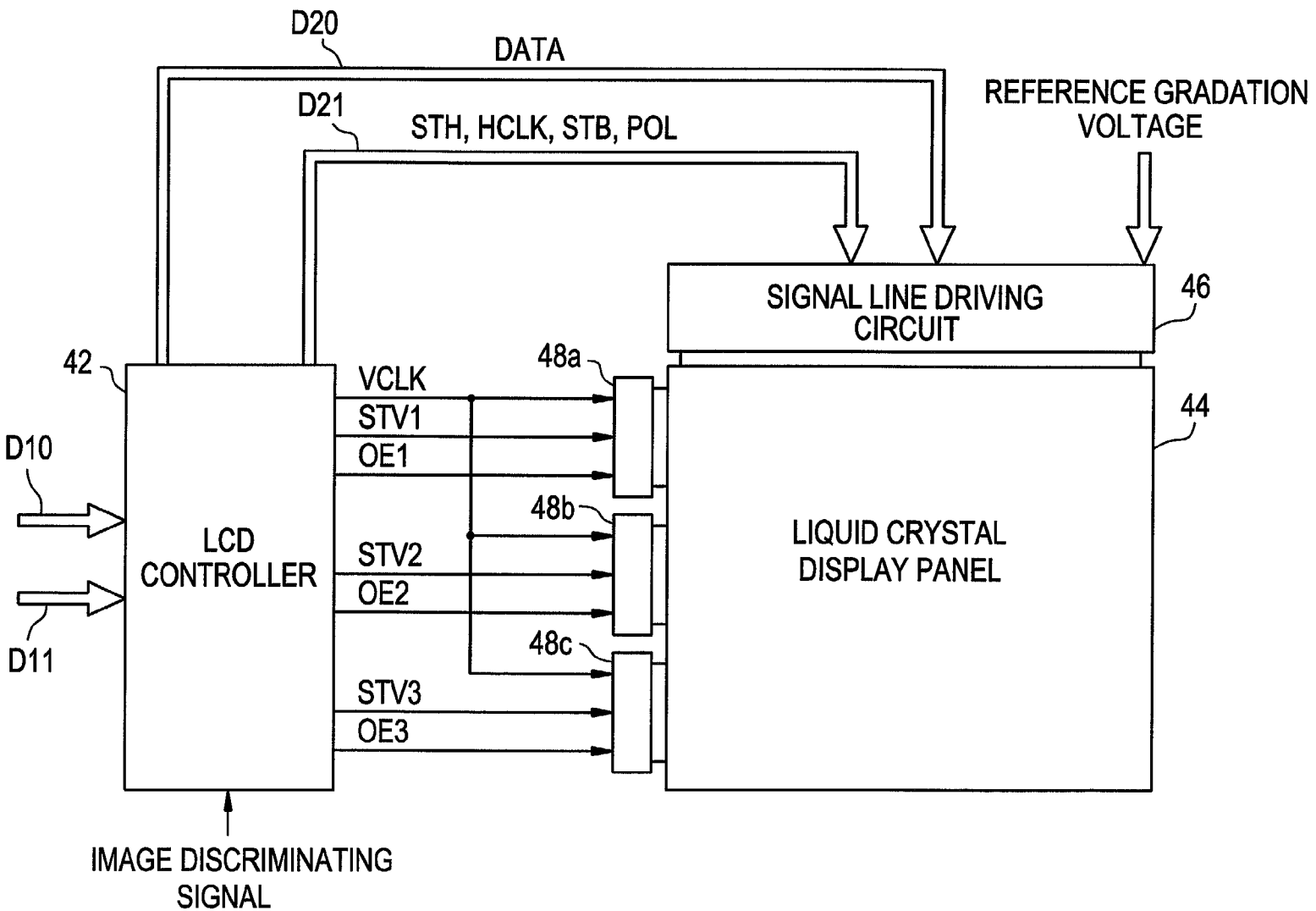
FIG. 12 shows a concrete example of various signals output from an LCD controller 42 to the signal line driving circuit 46 and the scanning line driving circuit 48.

Next, the operation when a dynamic image is displayed and when a static image is displayed will be described, concretely showing gradation data D20 output from the LCD controller 42 to the signal line driving circuit 46, and the signal side control signal D21 and the scanning side control signal D22 output to the scanning line driving circuit 48. FIG. 12 shows a concrete example of various signals output from the LCD controller 42 to the signal line driving circuit 46 and the scanning line driving circuit 48. Generally, in case a liquid crystal display has a large area according to XGA, the signal line driving circuit 46 and the scanning line driving circuit 48 are composed of plural members. FIG. 12 shows a case that the scanning line driving circuit 48 shown in FIG. 9 is composed of three scanning line driving circuits 48*a* to 48*c*. The signal line driving circuit 46 is also composed of plural members, however, they are not shown in FIG. 12.

A scanning side start pulse (STV), a scanning side clock (VCLK) and an output control signal (OE) are output from the LCD controller 42 to each scanning line driving circuit 48*a* to 48*c*. Gradation data (Data), a signal side start pulse (STH), a signal side clock (HCLK), a signal output pulse (STB) and a polarity inversion pulse (POL) are output from the LCD controller 42 to the signal line driving circuit 46. As the LCD controller 42 controls by respectively outputting scanning side start pulses STV1 to STV3 to the scanning line driving circuits 48*a* to 48*c* and further, outputting output control signals OE1 to OE3, the scanning line driving circuits 48*a* to 48*c* are separately controlled by the LCD controller 42.

The scanning side start pulses STV1 to STV3 are respectively a pulse for instructing each scanning line driving circuit 48*a* to 48*c* to start scanning. That is, the scanning line driving circuit 48*a* starts scanning when the scanning side start pulse STV1 is input, the scanning line driving circuit 28*b* starts scanning when the scanning side start pulse STV2 is input, and the scanning line driving circuit 48*c* starts scanning when the scanning side start pulse STV3 is input. If three scanning line driving circuits 48*a* to 48*c* are provided, one frame period is divided into three and the liquid crystal display panel 44 is scanned from the upside to the downside because the scanning line driving circuits 48*a*, 48*b* and 48*c* scan each divided frame period in the order.

The above-mentioned output control signals OE1 to OE3 are for controlling whether one scanning line is activated or deactivated in a period for scanning one scanning line, when the scanning line driving circuits 48*a* to 48*c* scan, for example, two scanning lines. That is, in the first embodiment, as described referring to FIG. 10, a period in which one scanning line is scanned is divided into the selection period for image data t1 and the selection period for black display t2. A scanning line different from a scanning line activated to apply gradation voltage according to image data in the selection period for image data t1 is activated to apply voltage according to black display in the selection period for black display t2. Therefore, in the selection period for image data t1, a scanning line to apply voltage according to black display in the selection period for black display t2 is required to be deactivated and in the selection period for black display t2, a scanning line to apply gradation voltage according to image data in the selection period for image data t1 is required to be deactivated. The output control signals OE1 to OE3 are used to control the above-mentioned activation and inactivation of scanning lines.

Figure 13:
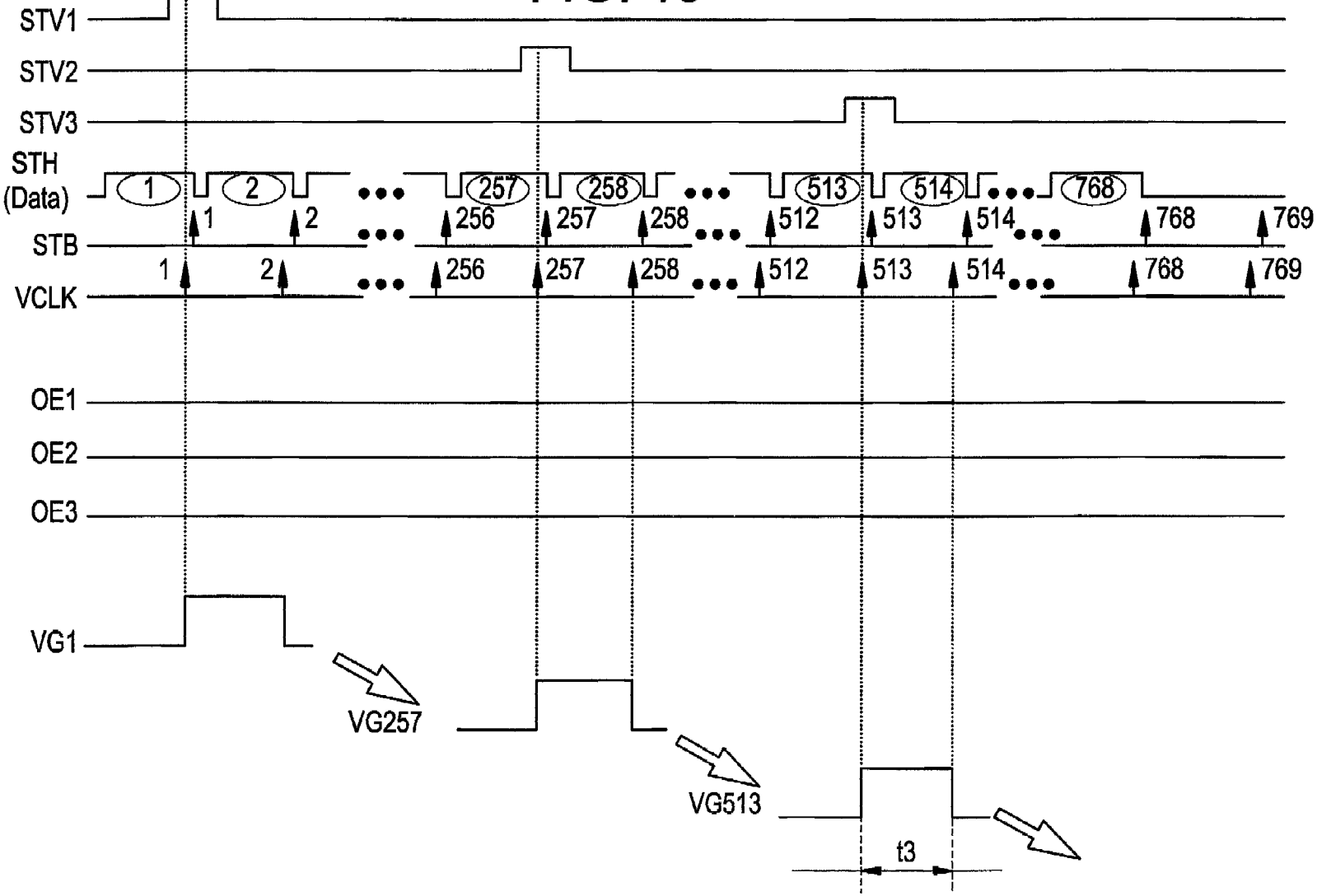
FIG. 13 is a timing chart showing various signals output from the LCD controller 42 when a static image is displayed.

Next, the operation when a static image is displayed will be described. As described above, when a displayed image is a static image, a value of an image discriminating signal output from the computer 30 shown in FIG. 9 is at a low level. FIG. 13 is a timing chart showing various signals output from the LCD controller 42 when a static image is displayed. In FIG. 13, signals for one frame if the liquid crystal display panel 44 has 768 scanning lines are shown. VG1, VG257 and VG513 respectively show the waveforms of scanning signals applied to first, 257th and 513th scanning lines. In case 768 scanning lines are provided, the scanning line driving circuit 48*a* scans the first to the 256th scanning lines, the scanning line driving circuit 48*b* scans the 257th to the 512th scanning lines and the scanning line driving circuit 48*c* scans the 513th to the 768th scanning lines.

As shown in FIG. 13, when a static image is displayed, scanning side start pulses STV1 to STV3 are respectively output to the scanning line driving circuits 48*a* to 48*c* in one frame period only once. Therefore, line-sequential driving is performed by the scanning line driving circuits 48*a* to 48*c*. As the control of the activation and inactivation of scanning lines in a period in which one scanning line is scanned is not required in case a static image is displayed, output control signals OE1 to OE3 are controlled so that they are always at a low level. As is clear from FIG. 13, when a static image is displayed, line-sequential driving is performed. That is, a scanning line is provided with fixed voltage in a period for scanning one scanning line and retained active.

When a static image is displayed, an image discriminating signal J1, the value of which is at a low level, is also input to the backlight control circuit 56 shown in FIG. 9. In this case, the backlight control circuit 56 sets the luminance of light emitted from the backlight 52 to the same extent as the luminance of light emitted from a backlight with which a conventional type liquid crystal display is provided.

Figure 14:
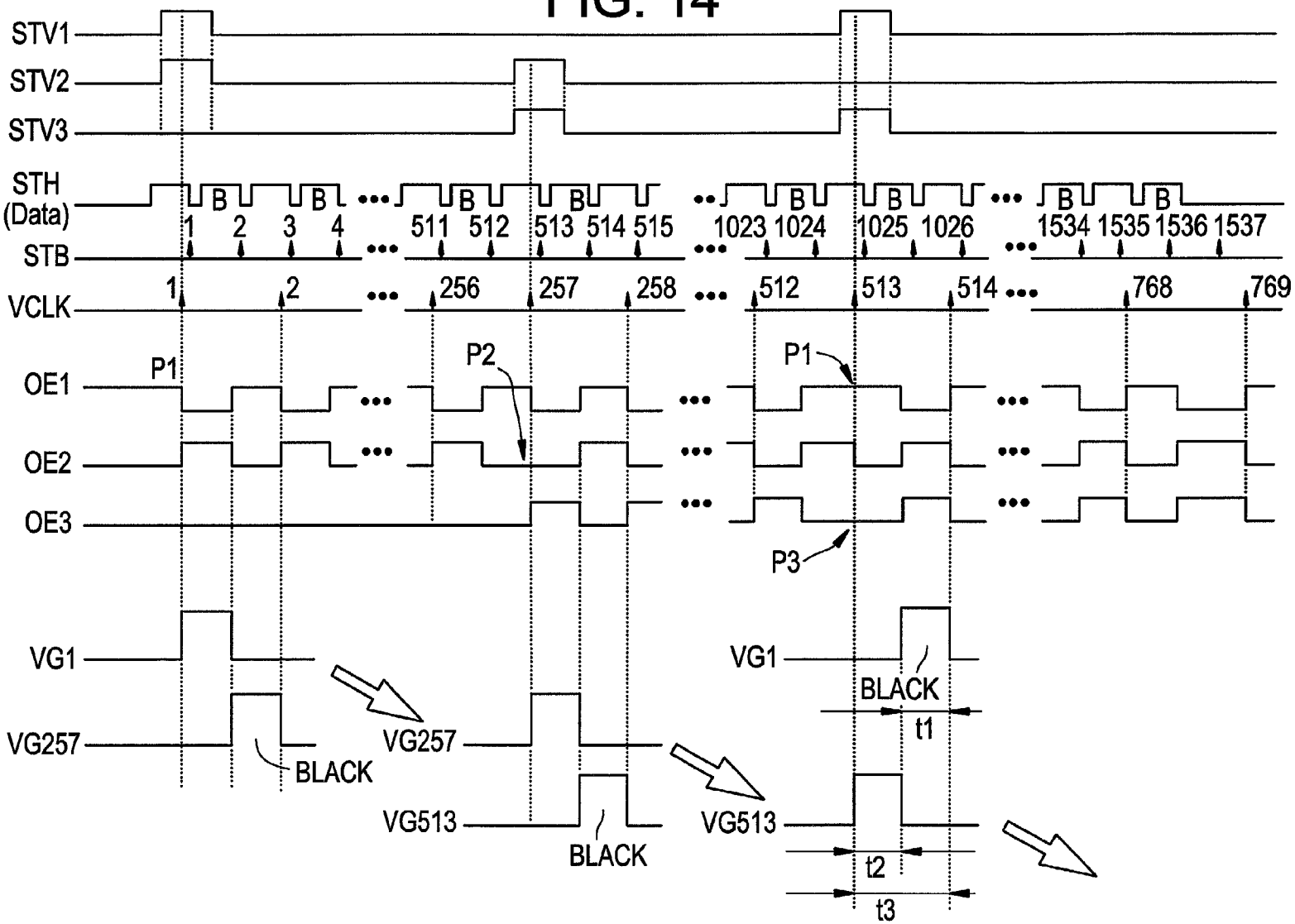
FIG. 14 is a timing chart showing various signals output from the LCD controller 42 when a dynamic image is displayed.

Next, the operation when a dynamic image is displayed will be described. As described above, in case a displayed image is a dynamic image, a value of an image discriminating signal output from the computer 30 shown in FIG. 9 is at a high level. FIG. 14 is a timing chart showing various signals output from the LCD controller 42 when a dynamic image is displayed. In FIG. 14, signals for one frame in case the liquid crystal display panel 44 has 768 scanning lines are also shown and VG1, VG257 and VG513 respectively show the waveforms of scanning signals applied to first, 257th and 513th scanning lines.

As shown in FIG. 14, when a dynamic image is displayed, scanning side start pulses STV1 to STV3 are respectively output to scanning line driving circuits 48*a* to 48*c* twice in one frame period and two scanning lines are scanned at a time. When a dynamic image is displayed, control is required to be performed so that only one of the two scanning lines scanned at a time is activated in a period in which one scanning line is scanned. Therefore, output control signals OE1 to OE3 are signals, the cycle of which is set to a half of a period in which one scanning line is scanned, and the phase of which is inverse only once in one frame. It is for the following reasons that the phase of the output control signals OE1 to OE3 is inverse only once in one frame.

That is, as shown in FIG. 12, gradation voltage according to image data and voltage according to black display are alternately supplied to the signal line driving circuit 46 from the LCD controller 42 (refer to STH (Data) shown in FIG. 14). In STH (Data) shown in FIG. 14, a location B is a location where voltage according to black display is supplied. In a state in which such a signal is supplied, as voltage applied to the pixel electrode 5 connected to a certain scanning line is required to be switched from gradation voltage according to image data to voltage according to black display and is required to be switched from voltage according to black display to gradation voltage according to image data, the inversion of the phase is made. In other words, to switch the selection period for image data t1 and the selection period for black display t2, phase inversion is made. In an example shown in FIG. 14, each polarity of output control signals OE1 to OE3 is inverted in locations P1 to P3. In the example shown in FIG. 14, black display is made on 256 scanning lines equivalent to one third of 768 scanning lines.

When a dynamic image is displayed, an image discriminating signal J1, the value of which is at a high level, is also input to the backlight control circuit 56 shown in FIG. 9. In this case, the backlight control circuit 56 controls so that the luminance of light emitted from the backlight 52 is set to a higher value than the luminance of light emitted from a backlight with which a conventional type liquid crystal display is provided. As described above, black display is made to prevent dim movement when a dynamic image is displayed. However, as the display luminance of the liquid crystal display panel 44 is deteriorated for black display, the deterioration of the display luminance is prevented by setting the luminance of light emitted from the backlight 52 to a high value.

In the above-mentioned embodiment, for the simplification of description, the case that the plural scanning line driving circuits 48*a* to 48*c* are provided and the scanning line connected to one of these circuits is set to the black screen display area A2 (see FIG. 11) is described. However, the area of the black screen display area A2 on the display screen of the liquid crystal display panel 44 can be set to an arbitrary value.

Next, a second illustrative, non-limiting embodiment of the present invention will be described. In the first illustrative embodiment of the present invention, the display method and the backlight of the liquid crystal display are controlled based upon whether image data is a dynamic image or a static image. In case a dynamic image is displayed, it may be also displayed on a part of the liquid crystal display panel 44. Dim movement caused in a hold-type display is caused by a difference between the amount of movement of a displayed dynamic image and the following kinetic competence of a person's eye. Therefore, it has been reported that the degree of dim movement is large when the mount of movement of a dynamic image is large on the liquid crystal display panel 44, and that the degree of dim movement is small when the amount of the movement of a dynamic image is small on the liquid crystal display panel 44 (refer to pp. 207 and 208 of SC-8-1 at 99' General Meeting of The Institute of Electronics, Information and Communication Engineers).

That is, when the dynamic image is displayed in a window, which is not a whole of the liquid crystal display panel 44, but is a part of the liquid crystal display panel 44, dim movement is not perceived so much, as long as the part of the liquid display panel 44 is proper size. That is because difference between the amount of the movement of a dynamic image and the following kinetic competence of a person's eye is small. Then, in the second embodiment of the present invention, the criterion of a display method of a liquid crystal display and the judgment of whether a backlight is controlled or not is based upon the area ratio of a liquid crystal display panel 44 and a window in which a dynamic image is displayed. That is, in case the area ratio of the liquid crystal display panel 44 and a window in which a dynamic image is displayed is a certain threshold or more, an image displayed on the liquid crystal display panel 44 is judged to be a dynamic image and an image discriminating signal J1 is turned to a high level. In the meantime, in cases when the area ratio of the liquid crystal display panel 44 and a window in which a dynamic image is displayed is smaller than a certain threshold, an image displayed on the liquid crystal display panel 44 is judged to be a static image and the image discriminating signal J1 is turned to a low level.

Figure 15:
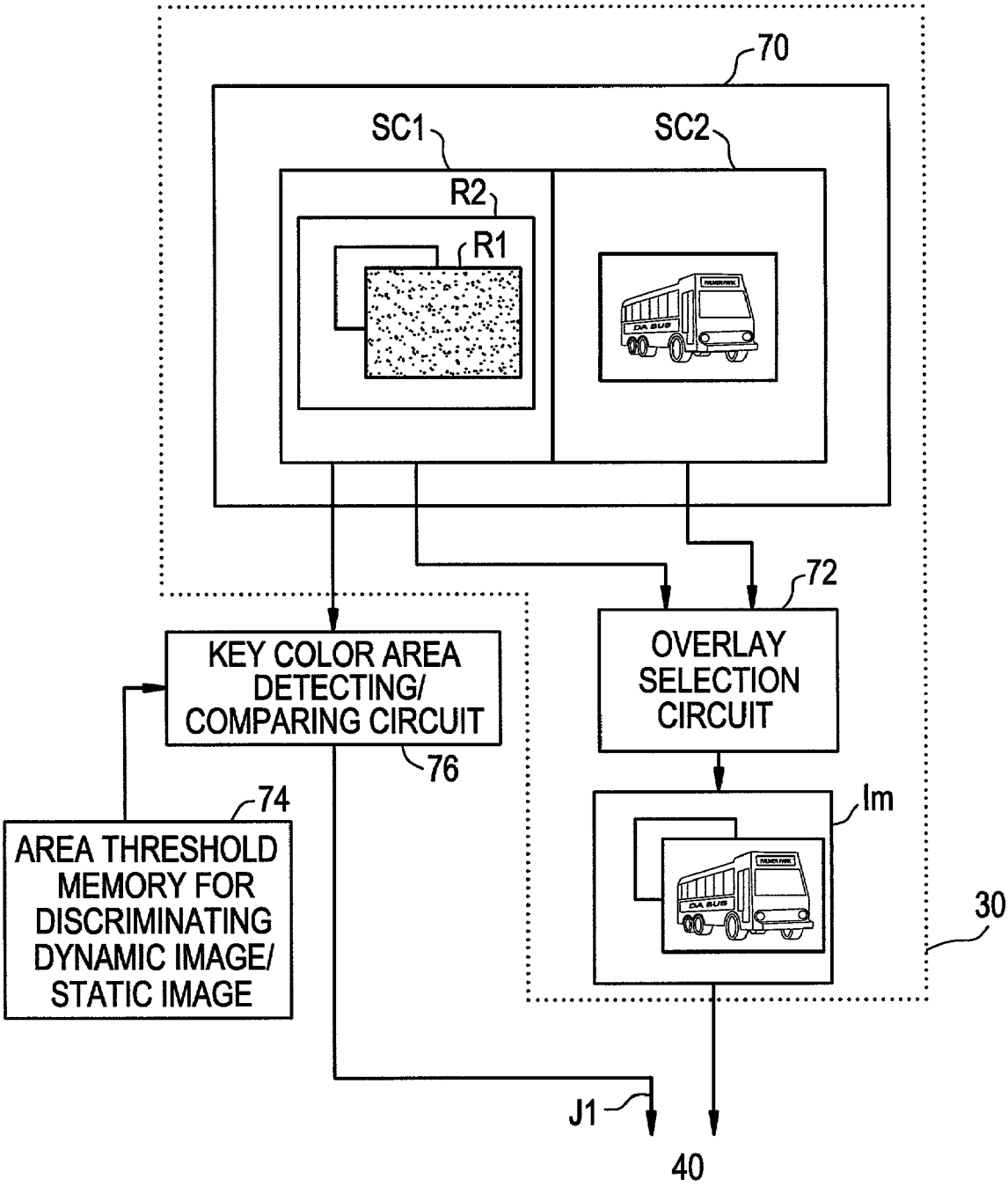
FIG. 15 is an explanatory drawing for explaining a principle to judge whether an image displayed on the liquid crystal display panel 44 is a dynamic image or not based upon the area ratio of the liquid crystal display panel 44 and a window.

FIG. 15 explains a principle for judging whether an image displayed on the liquid crystal display panel 44 is a dynamic image or not based upon the area ratio of the liquid crystal display panel 44 and the window. In case a dynamic image is handled by a computer 30, the processing speed is generally enhanced using an overlay function of hardware. As shown in FIG. 15, a reference number 70 denotes VRAM for temporarily storing image data. In VRAM 70, an on-screen area SC1 for temporarily storing image data for display and an off-screen area SC2 for temporarily storing dynamic image information are provided.

In case an application that handles a dynamic image is activated, an area R1 for defining in which position of the liquid crystal display panel 44 a dynamic image stored in the off-screen area SC2 is displayed is secured in the on-screen area SC1. An area R2 in the on-screen area SC1 shows a display area of the liquid crystal display panel 44 for example.

Data showing key color (for example, black and dark blue) is stored in the area R1. In case a dynamic image is displayed, an overlay selection circuit 72 generates the image data Im read in the area R1 in which data showing key color defined in the on-screen area SC1 is stored of a dynamic image temporarily stored in the off-screen area SC2, and displays the image data Im on the liquid crystal display 40. The above-mentioned structure is used heretofore to realize the overlay function.

In the second illustrative embodiment of the present invention, an area threshold memory for discriminating a dynamic image/a static image 74 and a key color area detecting/comparing circuit 76 are provided in addition to the above-mentioned configuration. The area threshold memory 74 stores a first predetermined threshold value to judge whether an image is a dynamic image or not. The first predetermined threshold value is an area ratio of the liquid crystal display panel 44 and the area R1 which defines the display area of a dynamic image. The key color area detecting/comparing circuit 76 judges whether an image is a dynamic image or not by detecting the area R1 data showing key color set in the on-screen area SC1 is stored, calculating the area ratio of the area R1 and an area R2 showing the display area of the liquid crystal display panel 44 and comparing this area ratio with the first predetermined threshold value stored in the area threshold memory 74, and outputs the result of the judgment as an image discriminating signal J1. An image judged to be a dynamic image includes an image in a part of which a dynamic image is included.

Figure 16:
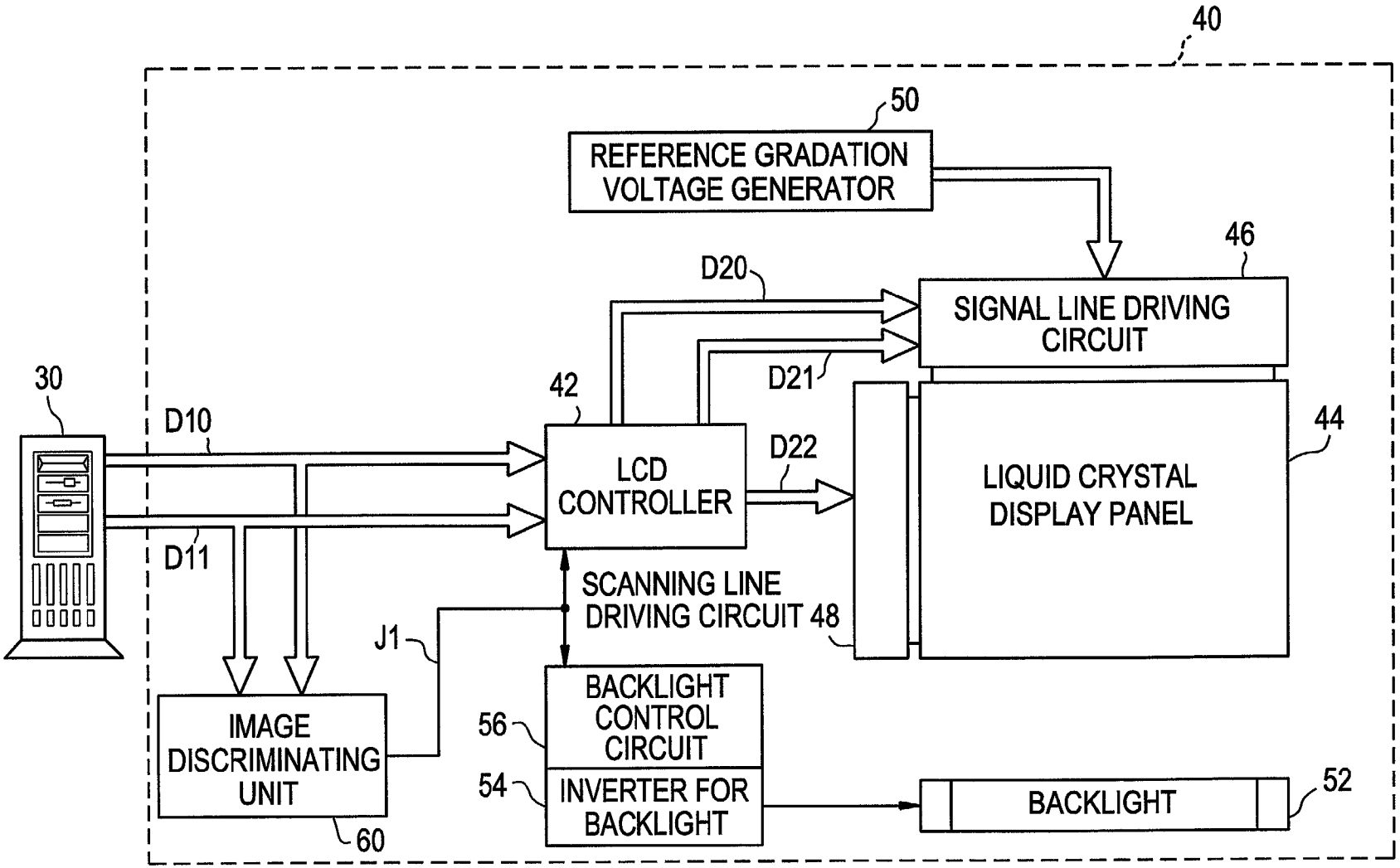
FIG. 16 is a functional block diagram showing the structure of a liquid crystal display equivalent to a third embodiment of the invention.

Next, a liquid crystal display according to a third illustrative, non-limiting embodiment of the present invention will be described. FIG. 16 is a functional block diagram showing the structure of the liquid crystal display according to the third illustrative embodiment of the present invention. The liquid crystal display shown in FIG. 16 is provided with an image discriminating circuit 60 for judging whether image data outputted from a computer 30 shows a dynamic image or not. The liquid crystal display shown in FIG. 16 is different from the liquid crystal display according to the first illustrative embodiment shown in FIG. 9 in that the image discriminating signal J1 outputted from the computer 30 shown in FIG. 9 is omitted.

In the first illustrative embodiment shown in FIG. 9, as the image discriminating signal J1 is outputted from the computer 30, a circuit for judging whether an image is a dynamic image or not is required to be provided in the computer 30. However, in the third illustrative embodiment, as the liquid crystal display 40 itself is provided with the image discriminating circuit 60 that judges whether an image is a dynamic image or not and the structure of the computer 30 is not required to be changed, the third illustrative embodiment is suitable for device configuration.

Figure 17:
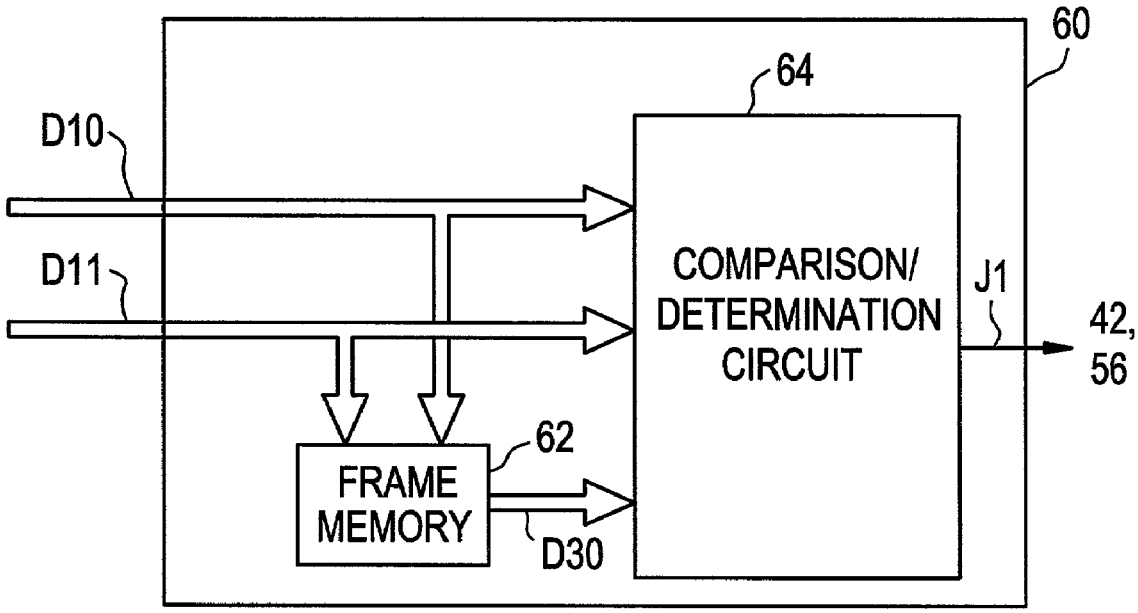
FIG. 17 is a functional block diagram showing the internal structure of an image discriminating circuit 60.

FIG. 17 is a functional block diagram showing the internal structure of the image discriminating circuit 60. The image discriminating circuit 60 is provided with a frame memory 62 and a comparison/determination circuit 64. The frame memory 62 stores image data outputted from the computer 30 for one frame. The comparison/determination circuit 64 compares image data outputted from the computer 30 and image data previous by one frame stored in the frame memory 62 and judges whether an image is a dynamic image or not.

Figure 18A:
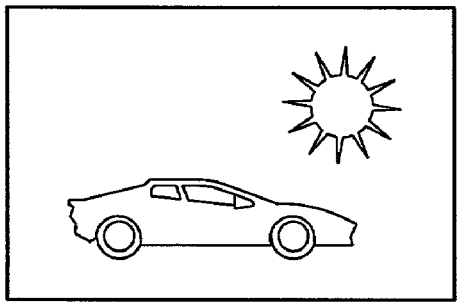
FIG. 18A is an explanatory drawing for explaining the operation of the image discriminating circuit.
Figure 18B:
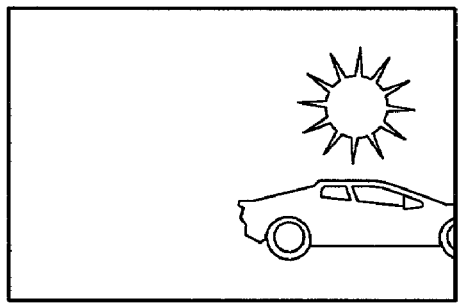
FIG. 18B is an explanatory drawing for explaining the operation of the image discriminating circuit.

Next, the operation of the image discriminating circuit 60 will be described. FIGS. 18A and 18B are explanatory drawings for explaining the operation of the image discriminating circuit. FIG. 18A shows an example of image data previous by one frame stored in the frame memory 62. FIG. 18B shows an example of the image data of a frame currently outputted from the personal computer 30. In the example shown in FIGS. 18A and 18B, a dynamic image of an automobile crossing in front and only movement of the automobile is shown. For such a dynamic image, the comparison/determination circuit 64 judges that image data outputted from the computer 30 is image data showing a dynamic image because image data is different between frames.

In the above-mentioned third embodiment, it is judged whether image data is a dynamic image or not based upon whether there is movement in two frames or not. However, the storage capacity of the frame memory 62 may be increased to store the image data of plural frames, and the plural frames may be compared in order to judge whether image data is a dynamic image or not.

In the above-mentioned third embodiment, image data is considered to be a dynamic image when there is any movement between frames. Therefore, an image discriminating signal J1 may be turned to a high level even if a display area where a dynamic image is displayed is so small that it might not necessary to control the LCD controller 112 as described in the first embodiment. Then, a frame may be divided in to a plurality of blocks, which is a detection area, and it may be detected how many detection areas have movement, instead of comparing whole frames. When a number of detection areas which have movement is larger than or equal to a second predetermined threshold value, an image data should be judged to be a dynamic image.

A few detection points may be set in the frame for detecting movement, instead of defining detection areas in the frame. When a number of detection points which have movement is larger than or equal to a third predetermined threshold value, an image data should be judged to be a dynamic image.

Figure 8:
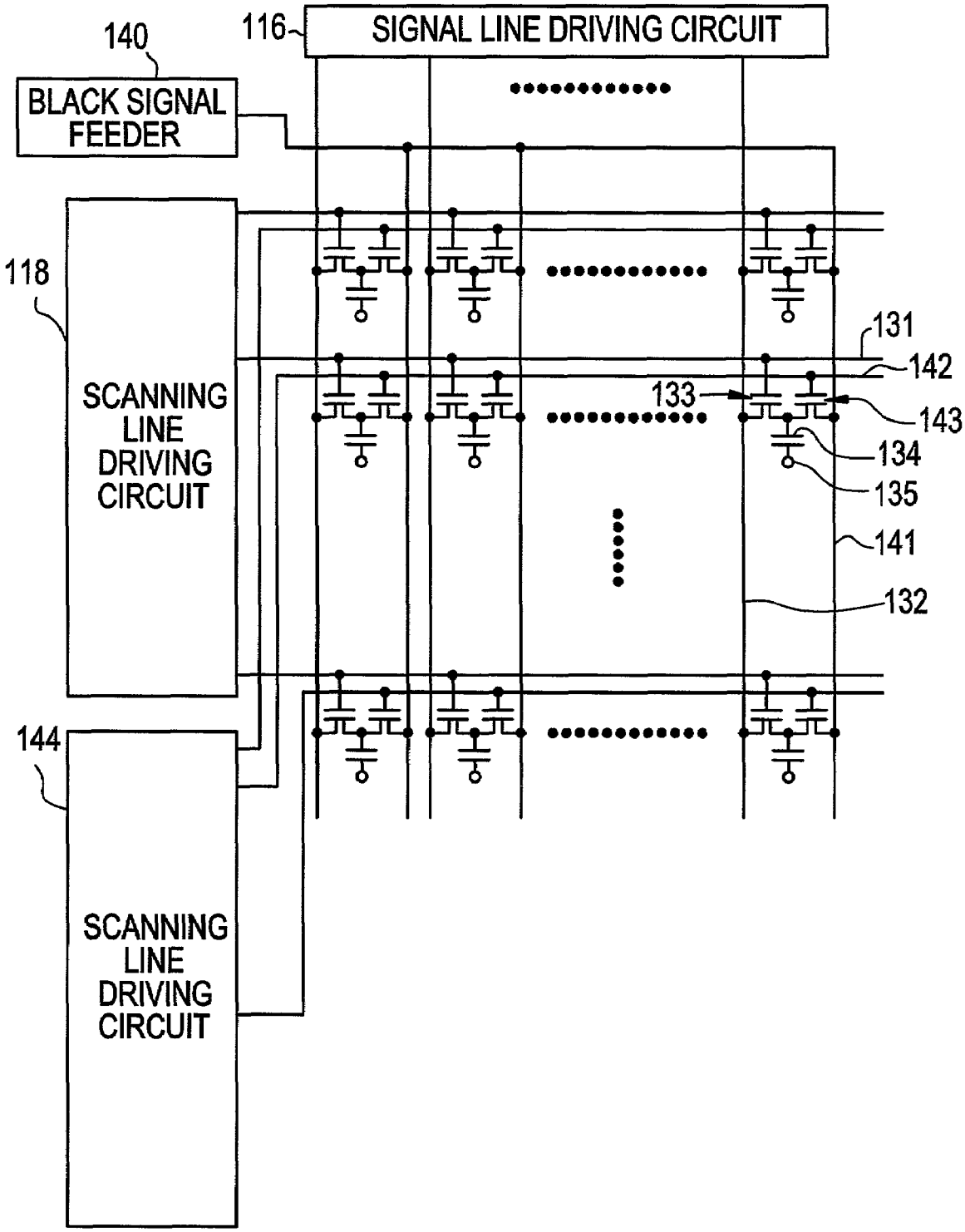
FIG. 8 PRIOR ART
FIG. 8 shows the structure of a liquid crystal display to solve a problem caused by the method shown in FIG. 7C.

The liquid crystal displays according to the embodiments of the present invention are described above. However, the present invention is not limited to the illustrative embodiments and the present invention may be freely changed in a scope of the present invention. For example, in the above-mentioned embodiments, black display is made by separating a period in which one scanning line is scanned into the selection period for image data t1 and the selection period for black display t2 so as to prevent dim movement. However, a method of black display is not limited to this and the embodiment can be also applied to the method described referring to FIGS. 7A to 7D and the liquid crystal display provided with the structure shown in FIG. 8. The invention is not limited to the case that black is displayed as the reset image and if dim movement can be prevented by displaying a single color as the reset image in a part of image data, the present invention can be applied, and one skilled in the art will readily know that the present invention can be applied to devices containing different layers and materials. Accordingly, other structural configurations may be used, without departing from the spirit and scope of the invention as defined in the claims.

As described above, according to the embodiment of the present invention, the luminance control circuit is provided to control the luminance of the backlight based upon whether a display image is a dynamic image or a static image. Therefore, the luminance may not be deteriorated even when a dynamic image is displayed.

Further, the display control circuit is provided to control so that a part or the whole of a dynamic image is turned to be a single color for a predetermined time based upon whether a displayed image is a dynamic image or a static image. Therefore, dim movement may be prevented.

When a static image is displayed, the display control circuit performs line-sequential driving, instead of turning a part of a static image or a whole of a static image into a single color. Therefore, the deterioration of image quality such as a flicker may be prevented. In addition, the deterioration of display luminance may also be prevented. As a result, as the luminance of the backlight is not required to be set to a high value, wasteful power consumption can be prevented.

What is claimed is:

1. A liquid crystal display comprising:

a display panel;

a back light irradiating through said display panel;

an input terminal receiving an image discriminating signal indicating whether an image displayed on said display panel is a dynamic image or not in response to a ratio of an area of said display panel to an area where said dynamic image is displayed;

a back light control circuit controlling a brightness of said back light;

wherein said brightness of said back light is set to a first predetermined brightness when said image discriminating signal indicates that said display panel displays a dynamic image and said brightness of said back light is set to a second predetermined brightness when said image discriminating signal indicates that said display panel displays a static image, wherein the first predetermined brightness is greater than the second predetermined brightness; and a display controller which displays a part or the whole of a dynamic image in a single color for a predetermined period when said image discriminating signal indicates that said display panel displays a dynamic image, and displays a static image without inserting a single color when said image discriminating signal indicates that said display panel displays a static image.

2. The liquid crystal display as claimed in claim 1, wherein said back light control circuit controls said back light based on an image discriminating signal indicating whether an image to be displayed on said display panel is the dynamic image or the static image.

3. The display as claimed in claim 1, wherein said single color is black.

4. The display as claimed in claim 1, further comprising:

a memory including an on-screen area including image information for display including a memory area for storing predetermined key color information for an area for displaying a dynamic image and an off-screen area including the image information of the dynamic image;

an overlay selection circuit that reads image information for display from the on-screen area, reads the image information of the dynamic image from the off-screen area, outputs image information corresponding to the image information for display to the liquid crystal display in case the image information for display is not the key color information and outputs the image information of the dynamic image to be liquid crystal display in case the image information for display is the key color information for displaying an image on the liquid crystal display;

an area threshold memory for discriminating dynamic image and a static image that stores the area ratio to discriminate whether an image displayed on the liquid crystal display panel is a dynamic image or not; and a liquid crystal key color area detecting/comparing circuit that detects the ratio of the image information for display which is a display area of the liquid crystal display panel in the on-screen area and an area in which the key color information is stored, compares the ratio and the area ratio stored in the area threshold memory for discriminating a dynamic image and a static image and outputs the image discriminating signal to the liquid crystal display.

5. A liquid crystal display comprising:

a display panel;

a back light irradiating through said display panel;

an input terminal receiving an image discriminating signal indicating an active state when an image to be displayed on said display panel is a dynamic image and an inactive state when an image to be displayed on said display panel is a static image;

a back light control circuit controlling a brightness of said back light; and a controller controlling said display panel in response to said image discriminating signal;

wherein said brightness of said back light is set to a first predetermined brightness when said image discriminating signal indicates the active state and said brightness of said back light is set to a second predetermined brightness when said image discriminating signal indicates the inactive state, wherein the first predetermined brightness is greater than the second predetermined brightness and wherein at least a part of said display panel displays a reset image only when said image discriminating signal indicates the active; and wherein said controller further displays a part or the whole of a dynamic image in a single color for a predetermined period when said image discriminating signal indicates that said display panel displays a dynamic image and displays a static image without inserting a single color when said image discriminating signal indicates that said display panel displays a static image.

6. The liquid crystal display as claimed in claim 5, wherein said display panel comprises a plurality of cells, and wherein at least a part of said plurality of cells displays a single color as said reset image.

7. The liquid crystal display as claimed in claim 5, wherein said display panel comprises:

a scanning line;

a signal line arranged substantially perpendicular to said scanning line; and a cell arranged at an intersection of said scanning line and said signal line, wherein at least a part of said cell displays a single color as said reset image.

8. The liquid crystal display as claimed in claim 7, wherein said controller activates a first scanning line at a first scanning period and provides an image data to a first signal line, and said controller activates a second scanning line at a second scanning period and provides reset data to said first signal line, and wherein said first scanning period and said second scanning period are included in a basic period for scanning said scanning line.

9. The liquid crystal display as claimed in claim 8, further comprises at least one of a third scanning line arranged between said first scanning line and said second scanning line.

10. The liquid crystal display as claimed in claim 5, further comprising an image discriminating unit receiving image data and providing said image discriminating data indicating said active state into said back light control circuit when said image data comprises dynamic image data, wherein said dynamic image data is data related to said dynamic image.

11. The liquid crystal display as claimed in claim 10, wherein said image discriminating unit provides said image discriminating data indicating said inactive state into back light control circuit when said image data comprises static image data, and wherein said static image data is data related to said static image.

12. The liquid crystal display as claimed in claim 11, wherein said image data comprises a first part of said image data corresponding to a first frame and a second part of said image data corresponding to a second frame, and wherein said image discriminating unit divides said first part of said image data into a first plurality of partial data corresponding to a plurality of detecting blocks of said display panel and said second part of said image data into a second plurality of partial data corresponding to a plurality of detecting blocks of said display panel.

13. The liquid crystal display as claimed in claim 12, wherein said image discriminating unit comprises:

a memory storing said first part of said image data at said first frame, and a comparator detecting said first plurality of partial data at said first frame which is different from said second plurality of said second data at said second frame, providing a number of detected said first plurality of partial data at said first frame, and providing said image discriminating signal indicating said active state when said number is larger than a second threshold value.

14. The liquid crystal display as claimed in claim 11, wherein said image data comprises a first part of said image data corresponding to a first frame and a second part of said image data corresponding to a second frame, and wherein said image discriminating unit defines a first plurality of partial data corresponding to a plurality of detecting points of said display panel in said first part of said image data and a second plurality of partial data corresponding to a plurality of detecting points of said display panel in said second part of said image data.

15. The liquid crystal display as claimed in claim 14, wherein said image discriminating unit comprises:

a memory storing said first part of said image data at said first frame, and a comparator detecting said first plurality of partial data at said first frame which is different from said second plurality of said second data at second frame, providing a number of detected said first plurality of partial data at said first frame, and providing said image discriminating signal indicating said active state when said number is larger than a third threshold value.

16. A liquid crystal display comprising:

a display panel;

a back light irradiating through said display panel;

an input terminal receiving said image discriminating signal and providing said image discriminating signal to said controller and said back light control circuit;

a back light control circuit controlling a brightness of said back light; and a controller controlling said display panel in response to an image discriminating signal indicating an active state when an image to be displayed on said display panel is a dynamic image and an inactive state when an image to be displayed on said display panel is a static image, wherein said brightness of said back light is set to a first predetermined brightness when said image discriminating signal indicates the active state and said brightness of said back light is set to a second predetermined brightness when said image discriminating signal indicates the inactive state, wherein the first predetermined brightness is greater than the second predetermined brightness and wherein at least a part of said display panel displays a reset image only when said image discriminating signal indicates the active state;

wherein said image discriminating signal indicates said active state when a ratio of an area of said display panel to an area of said dynamic image is smaller than a first threshold value.

17. The liquid crystal display as claimed in claim 16, further comprising:

a computer comprising:

a memory storing said first threshold value; and a detector and comparator detecting said ratio of said area of said display panel to said area of said dynamic image, comparing said ratio to said first threshold value, and providing said image discriminating signal into said controller and said back light control circuit, wherein said image discriminating signal indicates said active state when said ratio is smaller than said first threshold value.

18. The liquid crystal display as claimed in claim 17, wherein said image discriminating signal indicates said inactive state when said ratio is smaller than said first threshold value.

19. A liquid crystal display comprising:

a display panel;

a back light irradiating through said display panel;

an input terminal receiving said image discriminating signal and providing said image discriminating signal to said controller and said back light control circuit;

a back light control circuit controlling a brightness of said back light; and a controller controlling said display panel in response to an image discriminating signal indicating an active state when an image to be displayed on said display panel is a dynamic image and an inactive state when an image to be displayed on said display panel is a static image, wherein said brightness of said back light is set to a first predetermined brightness when said image discriminating signal indicates the active state and said brightness of said back light is set to a second predetermined brightness when said image discriminating signal indicates the inactive state, wherein the first predetermined brightness is greater than the second predetermined brightness and wherein at least a part of said display panel displays a reset image only when said image discriminating signal indicates the active state;

an image discriminating unit receiving image data and providing said image discriminating data indicating said active state into said back light control circuit when said image data comprises dynamic image data, wherein said dynamic image data is data related to said dynamic image; wherein said image discriminating unit provides said image discriminating data indicating said inactive state into back light control circuit when said image data comprises static image data, and wherein said static image data is data related to said static image; and wherein said image data comprises a first part of said image data corresponding to a first frame and a second part of said image data corresponding to a second frame, and wherein said image discriminating unit comprises a memory storing said first part of said image data at said first frame, and a comparator comparing said first part of said image data with said second part of said image data at said second frame, and detecting that said image data comprises said dynamic image data when said first part of said image data is different from said second part of said image data.

20. The liquid crystal display as claimed in claim 19, wherein said comparator detects that said image data comprises said static image data when said first part of said image data is the same as said second part of said image data.

21. A liquid crystal display device comprising:

a liquid crystal display panel including a plurality of scanning lines, a plurality of signal lines intersecting said scanning lines, and a plurality of driving elements, each disposed at an associated one of intersections of said scanning lines and said signal lines;

a backlight unit provided to illuminate said liquid crystal display panel; and a control/drive circuit controlling and driving said liquid crystal display panel to enable a display of a dynamic image and a static image, wherein said control/drive circuit is adapted, when said dynamic image is displayed, to perform a dynamic display mode in which each of the scanning lines contained in at least a dynamic image displaying portion of said liquid crystal display panel is activated two times during one frame period and each of said signal lines is supplied with image data during one of said two times and with a signal unrelated to the image data during the other of said two times.

22. The device as claimed in claim 21, wherein said backlight unit is controlled to illuminate said liquid crystal display panel upon displaying said dynamic image more brightly than upon displaying said static image.

23. The device as claimed in claim 21, wherein, between first and second activations of one of the scanning lines, at least another one of the scanning lines is activated.

24. The device as claimed in claim 21, wherein said control/drive circuit is adapted, when said static image is displayed, to perform a static display mode in which each of the scanning lines contained in at least a static image displaying portion of said liquid crystal display panel is activated once during one frame period and each of said signal lines is supplied with image data during the activation of the scanning line.

25. The device as claimed in claim 24, wherein said control/drive circuit displays said static image on a first area of said liquid crystal display panel and said dynamic image on a second area of said liquid crystal display panel, wherein said control/drive circuit performs said static display mode when a ratio of said first area to said second area is greater than a predetermined value irrespective of whether said dynamic image is required to be displayed.

* * * * *